US011002061B1

(12) United States Patent
Maiga et al.

(10) Patent No.: US 11,002,061 B1
(45) Date of Patent: May 11, 2021

(54) ELECTRONIC DOOR SYSTEM

(71) Applicant: PassiveBolt, Inc., Ann Arbor, MI (US)

(72) Inventors: Kabir Zachary Maiga, Superior Township, MI (US); Philip Michael Johnson, Plymouth, MI (US); Simon Forster, Cologne (DE)

(73) Assignee: PassiveBolt, Inc., Ann Arbor, MI (US)

( * ) Notice: Subject to any disclaimer, the term of this patent is extended or adjusted under 35 U.S.C. 154(b) by 0 days.

(21) Appl. No.: 16/806,678

(22) Filed: Mar. 2, 2020

Related U.S. Application Data

(60) Provisional application No. 62/957,200, filed on Jan. 4, 2020.

(51) Int. Cl.

| | |
|---|---|
| ***E05F 15/77*** | (2015.01) |
| ***E05F 15/48*** | (2015.01) |
| ***E05B 63/00*** | (2006.01) |
| ***E05B 47/00*** | (2006.01) |
| ***E05B 47/02*** | (2006.01) |
| *E05B 17/00* | (2006.01) |

(52) U.S. Cl.
CPC ..... *E05F 15/77* (2015.01); *E05B 47/0001* (2013.01); *E05B 47/026* (2013.01); *E05B 63/0052* (2013.01); *E05F 15/48* (2015.01); *E05B 17/0029* (2013.01); *E05B 2047/0094* (2013.01); *E05Y 2900/132* (2013.01)

(58) Field of Classification Search
None
See application file for complete search history.

(56) References Cited

U.S. PATENT DOCUMENTS

| | | | |
|---|---|---|---|
| 697,599 | A | 4/1902 | Barrett |
| 5,134,870 | A | 8/1992 | Uyeda et al. |
| 5,199,288 | A | 4/1993 | Merilainen et al. |
| 5,666,830 | A | 9/1997 | Litvin |
| 5,758,527 | A | 6/1998 | Crepinsek |
| 5,839,307 | A | 11/1998 | Field et al. |
| 6,032,500 | A | 3/2000 | Collard, Jr. et al. |

(Continued)

FOREIGN PATENT DOCUMENTS

| | | | | |
|---|---|---|---|---|
| CN | 203838826 U | | 9/2014 | |
| GB | 2516218 A | * | 1/2015 | ..... E06B 7/30 |

(Continued)

OTHER PUBLICATIONS

International Search Report and Written Opinion in PCT/US2019/020028, dated May 30, 2019, 8 pages.
U.S. Pat. No. 697,599; Barrett, C.W.; published Apr. 15, 1902.

*Primary Examiner* — Catherine A Kelly
(74) *Attorney, Agent, or Firm* — Young Basile Hanlon & MacFarlane, P.C.

(57) ABSTRACT

An electronic door system is disclosed for a door that selectively closes a door opening of a building structure. The electronic door system includes two or more of a gyroscope that senses angular velocity of the door, an accelerometer that senses acceleration of the door, a capacitive sensor that capacitively senses the building structure, or a microphone that senses sound of the door. The electronic door system also includes a controller that assesses a physical position of the door according to the two or more of the gyroscope, the accelerometer, the capacitive sensor, or the microphone.

20 Claims, 12 Drawing Sheets

(56) References Cited

U.S. PATENT DOCUMENTS

| | | | | |
|---|---|---|---|---|
| 7,050,897 | B2 * | 5/2006 | Breed | B60C 11/24 701/46 |
| 7,775,072 | B2 | 8/2010 | Pullmann | |
| 7,908,896 | B1 | 3/2011 | Olson et al. | |
| 8,773,263 | B2 * | 7/2014 | Thibault | G08B 13/08 340/545.1 |
| 9,024,759 | B2 | 5/2015 | Uyeda | |
| 9,142,108 | B2 * | 9/2015 | Seelman | G08B 13/08 |
| 9,322,194 | B2 | 4/2016 | Cheng | |
| 9,340,999 | B2 | 5/2016 | Romero | |
| 9,390,572 | B2 | 7/2016 | Almomani | |
| 9,406,181 | B2 | 8/2016 | Almomani et al. | |
| 9,424,700 | B2 | 8/2016 | Lovett | |
| 9,546,504 | B2 | 1/2017 | Overgaard | |
| 9,670,696 | B2 | 6/2017 | Chong | |
| 9,697,302 | B2 | 7/2017 | Nguyen et al. | |
| 9,719,278 | B2 | 8/2017 | Taylor | |
| 9,822,553 | B1 * | 11/2017 | Ho | E05B 47/0012 |
| 9,871,399 | B2 * | 1/2018 | Mittleman | E05F 15/72 |
| 9,890,565 | B2 | 2/2018 | Shiu | |
| 10,240,365 | B2 | 3/2019 | Almomani | |
| 10,662,692 | B2 * | 5/2020 | Brueckner | B60J 5/10 |
| 10,663,479 | B2 * | 5/2020 | He | G01C 1/00 |
| 2003/0160681 | A1 | 8/2003 | Menard et al. | |
| 2004/0237609 | A1 | 12/2004 | Hosselet | |
| 2005/0179517 | A1 | 8/2005 | Harms et al. | |
| 2009/0273440 | A1 | 11/2009 | Marschalek et al. | |
| 2013/0176107 | A1 | 7/2013 | Dumas et al. | |
| 2014/0077929 | A1 | 3/2014 | Dumas | |
| 2014/0113563 | A1 | 4/2014 | Almomani et al. | |
| 2014/0157842 | A1 | 6/2014 | Almomani et al. | |
| 2014/0260448 | A1 | 9/2014 | Beck et al. | |
| 2014/0260449 | A1 | 9/2014 | Uyeda et al. | |
| 2015/0225983 | A1 | 8/2015 | Alzingre et al. | |
| 2015/0279136 | A1 | 10/2015 | Lovett et al. | |
| 2015/0101370 | A1 | 12/2015 | Russo | |
| 2016/0284148 | A1 | 9/2016 | Almomani | |
| 2016/0284181 | A1 | 9/2016 | Johnson | |
| 2017/0076520 | A1 | 3/2017 | Ho et al. | |
| 2017/0204636 | A1 | 7/2017 | Sack | |
| 2017/0263065 | A1 | 9/2017 | Johnson | |
| 2018/0051509 | A1 * | 2/2018 | German | E05C 9/00 |
| 2018/0080250 | A1 | 3/2018 | Martin et al. | |
| 2019/0178003 | A1 | 6/2019 | Martin et al. | |
| 2019/0186169 | A1 | 6/2019 | Ho | |
| 2019/0213813 | A1 | 7/2019 | Chong et al. | |
| 2019/0242170 | A1 * | 8/2019 | Brueckner | E05F 15/60 |

FOREIGN PATENT DOCUMENTS

| | | | |
|---|---|---|---|
| TW | 201638445 | A | 11/2016 |
| WO | 91/19068 | A1 | 12/1991 |
| WO | 9921200 | A2 | 4/1999 |
| WO | 0186097 | A2 | 11/2001 |
| WO | 2006001572 | A1 | 1/2006 |
| WO | 2009024961 | A2 | 2/2009 |
| WO | 2011128901 | A1 | 10/2011 |
| WO | 2015054667 | A1 | 4/2015 |
| WO | 2015138755 | A1 | 9/2015 |
| WO | 2016130777 | A1 | 8/2016 |

* cited by examiner

ELECTRONIC DOOR SYSTEM

CROSS-REFERENCE TO RELATED APPLICATION(S)

This application claims priority to and the benefit of U.S. Provisional Application No. 62/957,200, filed Jan. 4, 2020, the entire disclosure of which is incorporated by reference herein.

TECHNICAL FIELD

This disclosure relates to building entry doors and, in particular, electronic door systems and electronic door lock systems for building entry doors.

BACKGROUND

Building door security systems may include door sensors for determining whether a building door or other entry point (e.g., a window) is open or closed. Conventional door sensors are multi-component systems that include a permanent magnet that is affixed to and moves with the door and a magnetic sensor that is affixed to a non-moving portion of the building (e.g., molding surrounding door opening). When the door is closed, the magnetic sensor detects the permanent magnet and sends a corresponding signal.

SUMMARY

Disclosed herein are implementations of electronic door systems, electronic door lock systems, and related methods.

In an embodiment, an electronic door system is disclosed for a door that selectively closes a door opening of a building structure. The electronic door system includes two or more of a gyroscope that senses angular velocity of the door, an accelerometer that senses acceleration of the door, a capacitive sensor that capacitively senses the building structure, or a microphone that senses sound of the door. The electronic door system also includes a controller that assesses a physical position of the door according to the two or more of the gyroscope, the accelerometer, the capacitive sensor, or the microphone.

The electronic door system may include each of the accelerometer, the capacitive sensor, and the microphone. The electronic door system may include a wireless communications device. The controller may assess the physical position of the door by determining an angular position assessment of the door according to the gyroscope. If the angular position assessment is below an angular threshold of 10 degrees or less from a closed physical position, the controller may assess the physical position according to one or more of the accelerometer, the capacitive sensor, or the microphone. The controller may compare the acceleration of the door sensed by the accelerometer to an acceleration profile of the door indicative of the door being closed to assess the physical position of the door. The controller may compare the capacitance sensed by the capacitive sensor to a capacitance criterion indicative of the door being closed to assess the physical position of the door. The capacitance criterion may have been determined according to a previous occurrence of capacitively sensing the building structure with the capacitive sensor with the door in a closed physical position. The controller may compare the sound sensed by the microphone to a sound criterion to assess the physical position of the door. The sound criterion may have been determined according to a previous occurrence of sensing the sound with the microphone while the door was moved into the closed physical position. The electronic door system may be coupleable to the door such that the two or more gyroscope, the accelerometer, the capacitive sensor, and the microphone move with the door as the door is moved to selectively close the door opening of the building structure The controller may the physical position of the door to determine a door status. The wireless communications device may communicate the door status to another device.

In an embodiment, an electronic door system is disclosed for a door that selectively closes a door opening of a building structure. The electronic door system includes a capacitive sensor that capacitively senses the building structure, and a controller that assesses whether the door is closed according to the capacitive sensor. The electronic door system may further include a gyroscope that senses angular velocity of the door, and the controller may assess whether the door is closed according to the gyroscope. The electronic door system may further include an accelerometer that senses acceleration of the door in a direction perpendicular to a plane of the door, and the controller may assess whether the door is closed according to the accelerometer.

In an embodiment, a method is disclosed for assessing a physical position of a door that selectively closes a door opening of a building structure. The method includes: sensing at a first time, with a sensor, a door position condition that is indicative of the physical position of the door; determining, with a controller, a door position criterion according to the door position condition from the first time; sensing at a second time, with the sensor, the door position condition, the second time being after the first time; and comparing, with the controller, the door position condition from the second time to the door position criterion to assess the physical position of the door. The sensor is one of an accelerometer, a capacitive sensor, or a microphone. The door position condition is one of acceleration of the door in a direction perpendicular to a plane of a door, capacitance of the building structure, or a sound of the door closing.

The method may further include: sensing at a third time, with the sensor, the door position condition, the third time being after the second time; determining, with the controller, an updated door position criterion according to the door position condition from the third time; sensing at a fourth time, with the sensor, the door position condition, the fourth time being after the third time; and, comparing, with the controller, the door position condition from the fourth time to the updated door position criterion to assess the physical position of the door.

BRIEF DESCRIPTION OF THE DRAWINGS

The disclosure is best understood from the following detailed description when read in conjunction with the accompanying drawings. It is emphasized that, according to common practice, the various features of the drawings are not to-scale. On the contrary, the dimensions of the various features are arbitrarily expanded or reduced for clarity.

DETAILED DESCRIPTION

Figure 1B:
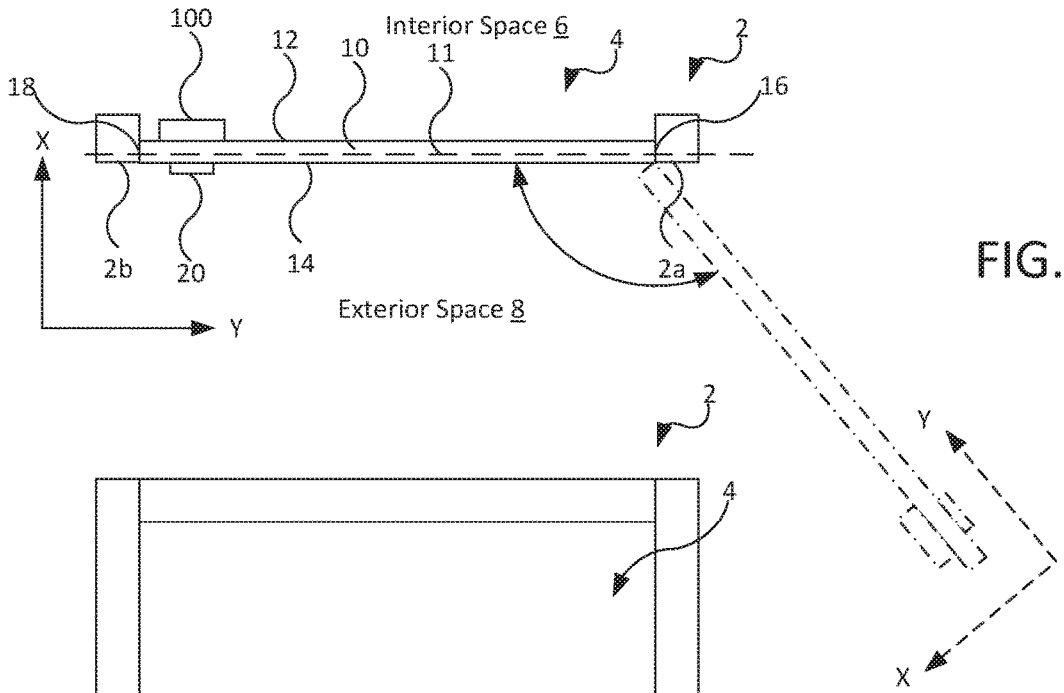
FIG. 1B is a top view of the building structure, door, and electronic door system of FIG. 1B.
Figure 1A:
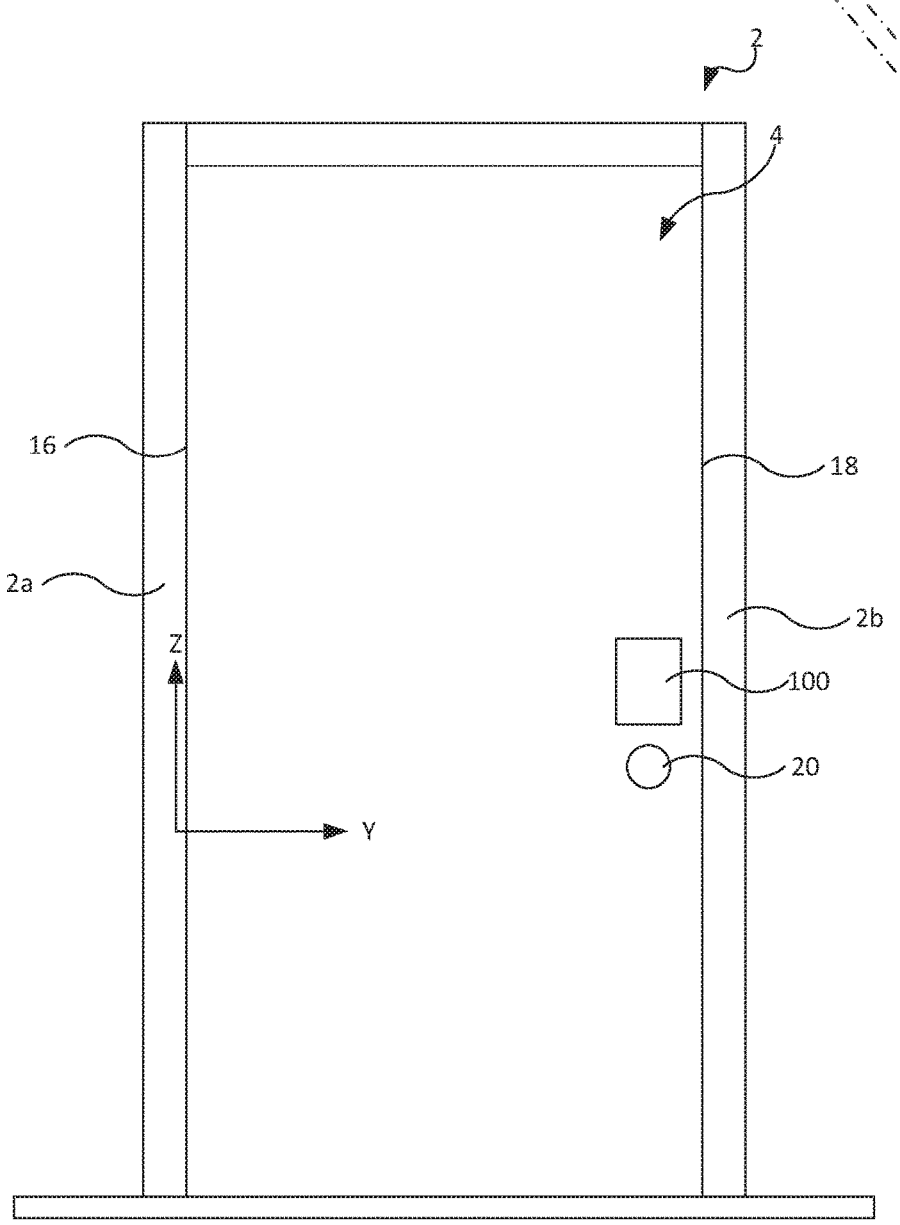
FIG. 1A is a front view of a building structure having a door opening that is closed by a door having an electronic door system.

Referring to FIGS. 1A and 1B, an electronic door system 100 is coupled to a door 10 of a building structure and assesses a physical position of the door 10, for example, determining a position status of the door 10 as closed, open, or an angle of the door 10 relative to a reference value (e.g., zero degrees when closed). The electronic door system 100 may communicate the position status, such as to provide a notification to a user or a security company. The electronic door system may, instead or additionally, perform other functions related to the door 10, such as operating a deadbolt lock, sensing user, and/or sensing an electronic key associated with a user, which may be performed according to the position status of the door 10. The electronic door system 100 may be a self-contained sensor system that assesses the physical position of the door without separate dedicated components (e.g., a permanent magnet on the building structure as described previously).

As shown in FIG. 1B, the building structure 2 generally defines an interior space 6 (e.g., an interior of the building structure 2) that is separated from an exterior space 8 (e.g., the outside environment) by the building structure 2 and selectively separated from the exterior space 8 by the door 10. The door 10 is movable relative to a building structure 2 to selectively close and open a door opening 4 thereof. In FIG. 1B, the door 10 is illustrated in solid lines in a closed physical position and in dashed lines in an open physical position.

The building structure 2 includes a hinge-side jamb 2*a* and a latch-side jamb 2*b* that form the vertical sides of the door opening 4, as well as a head jamb (not labeled) and a sill (not labeled) that define upper and lower horizontal sides of the door opening 4. For example, the building structure 2 may include a door frame that includes the hinge-side jamb 2*a*, the latch-side jamb 2*b*, the head jamb, and the sill. In the case of french doors, the building structure 2 may be considered to include another door that forms the latch-side jamb 2*b* of the door opening 4.

The door 10 includes an interior side 12, an exterior side 14, a hinge edge 16, a latch edge 18, and upper and lower edges (not labeled). The hinge edge 16 is rotatably coupled (e.g., hingedly coupled) to the hinge-side jamb 2*a* of the building structure 2, such that the door 10 is rotatable relative to the building structure 2 about a hinge axis, which is vertical and may also be referred to as the Z-axis (as shown). A direction perpendicular to a plane 11 of the door 10 may be considered the X-axis, while a horizontal direction in the plane 11 of the door 10 may be considered the Y-axis.

As used herein, the term "physical position" generally refers to the actual position of the door 10 within a physical environment, while the term "position status" generally refers to an assessment or determination of the physical position of the door 10. The physical position and the position status may be described as open or closed or with other similar or equivalent terms. An angular position assessment refers to an assessment or determination of the angular position of the door 10, which may also indicate whether the position status is closed or open (e.g., a zero angular position may further indicate that door status is closed, while a non-zero angular position may mean that the door status is open). It should be understood that the door status and angular position assessment may not accurately reflect the physical position of the door 10, the present application and the electronic door system 10 is configured to provide improved accuracy, for example, by assessing multiple door position criteria.

While the electronic door system 100 is discussed herein with respect to a building structure 2, it is further contemplated that the door system 100 may be using in other contexts to assess the physical position of a swinging (e.g., hinged structure) relative to another structure (e.g., doors in non-building applications and gates, among other applications).

Figure 2:
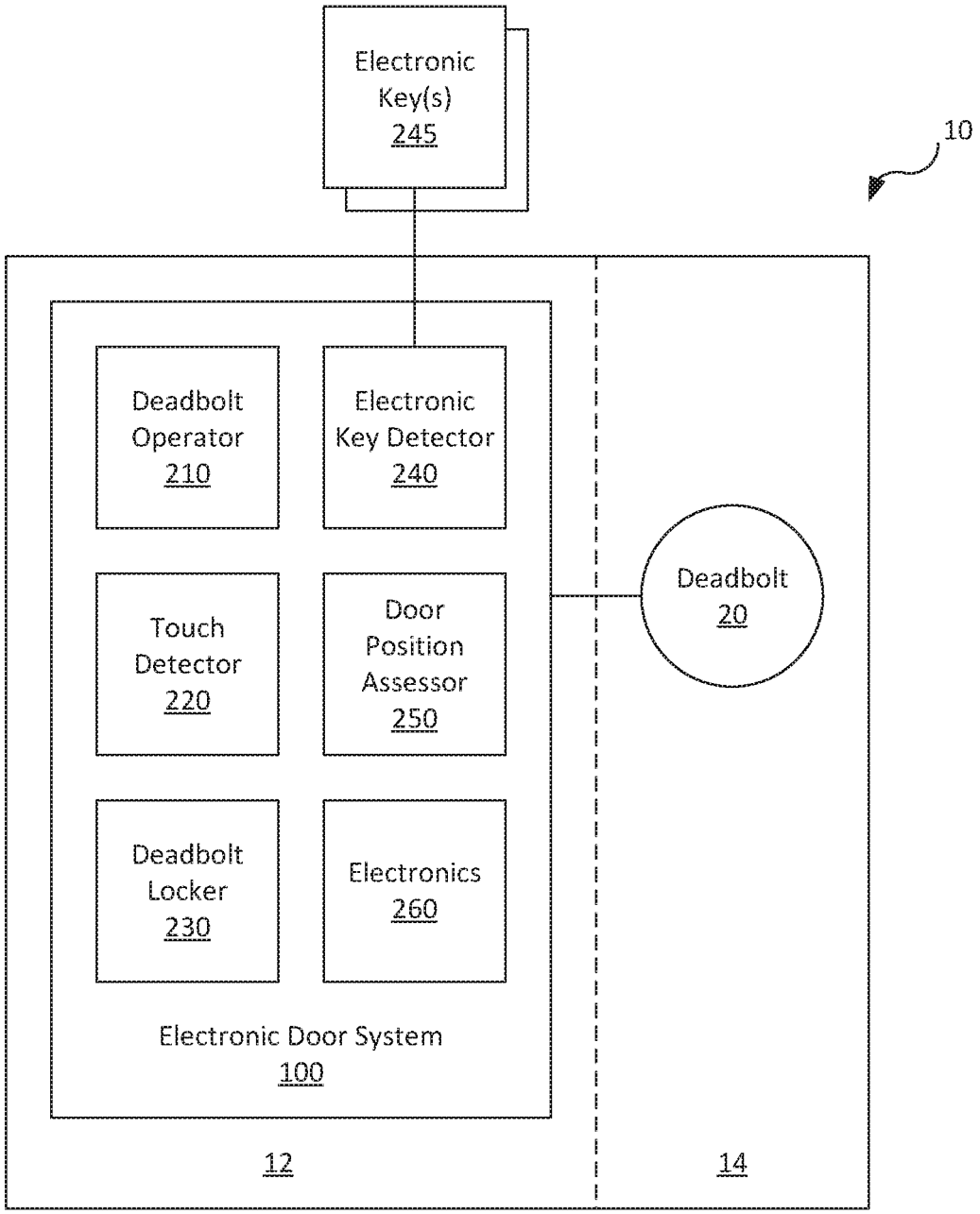
FIG. 2 is a schematic view of a door having the electronic door system of FIGS. 1A-1B and a deadbolt.

Referring to FIG. 2, the electronic door system 100 is coupleable to the door 10, such that the electronic door system 100 and the components thereof move as the door 10 is rotated about the hinge axis (i.e., the Z-axis). The electronic door system 100 may be further coupleable to and/or operatively associated with a deadbolt lock 20 associated with the door 10. As referenced above, the electronic door system 100 assesses the physical position of the door 10 is coupled and may additionally be configured to perform other functions related to the door 10, such as operating the deadbolt lock 20. More particularly, the electronic door system 100 includes a door position assessor 250 and may, in some embodiments, further include one or more other subsystems of a deadbolt operator 210, a touch detector 220, a deadbolt locker 230, or an electronic key detector 240, which may or may not share various components.

The door position assessor 250 is configured to assess the physical position of the door 10, for example, to determine whether the door 10 is closed (i.e., is in the closed physical position). The deadbolt operator 210 is configured to operate a deadbolt lock 20 associated with the door 10. The touch detector 220 is configured to detect touch (e.g., on an exterior side 14 of the door 10) and, for example, conductively couples to the deadbolt lock 20 to function as a capacitive electrode of the touch detector 220 for detecting touch capacitively therewith. The deadbolt locker 230 is configured to secure the deadbolt lock 20 by mechanically engaging the deadbolt lock 20 to prevent movement thereof between the locked stated and the unlocked state. The electronic key detector 240 is configured to detect electronic keys 245 associated with the electronic door system 100 and within a detection region, for example, to operate the deadbolt operator 210. The door position assessor 250, the deadbolt operator 210, the touch detector 220, and the electronic key detector 240 are each discussed in further detail below. It should be noted that the door position assessor 250, the deadbolt operator 210, the touch detector 220, and/or the electronic key detector 240 may be provided and/or used in any suitable combination with each other and/or with the deadbolt lock 20. For example, the door position assessor 250 may be provided without any of the deadbolt operator 210, the touch detector 220, or the electronic key detector 240. The electronic door system 100 may also be referred to as a door position sensor system and an intelligent door status device. When interfacing with or including the deadbolt lock 20, the electronic door system 100 may also be referred to as an electronic door lock, a locking device, a door locking device, a door locking device, or an electronic door lock system.

The electronic door system 100 further includes electronics 260, which function to operate and may form parts of the door position assessor 250, the deadbolt operator 210, the touch detector 220, the deadbolt locker 230, and/or the electronic key detector 240, for example, each being considered to include and/or share a controller 362 (discussed below) and/or one or more sensors 366. The various subsystems and the electronics may be coupled to each other (e.g., with a chassis, such as a circuit board and/or housing) and, thereby, be cooperatively couplable to the door 10.

Figure 3:
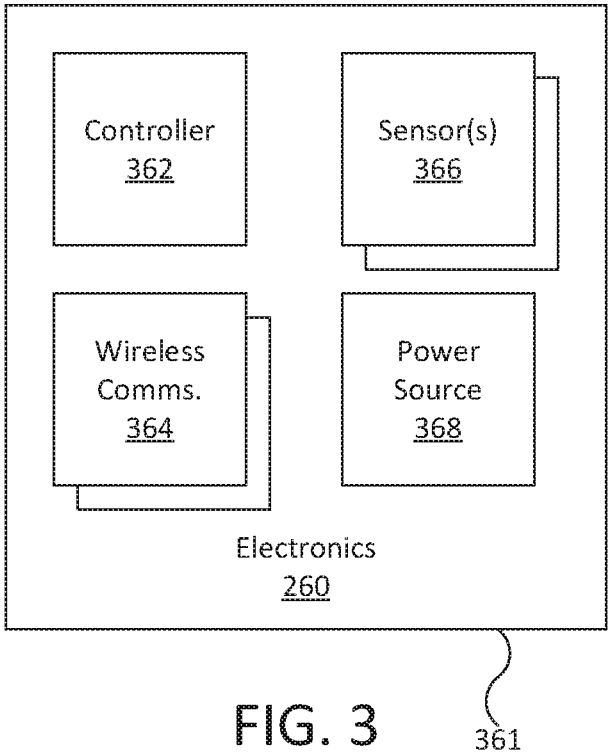
FIG. 3 is a schematic view of electronics of the electronic door system of FIG. 2.

Referring to FIG. 3, the electronics 260 generally include the controller 362, one or more wireless communication devices 364, one or more sensors 366, and a power source 368, which may be mounted to or otherwise coupled (e.g., electrically) to a circuit board 361. The controller 362 is configured to operate the various devices, subsystems, and/or components of the electronic door system 100, for example, being in communication with (e.g., being electrically coupled to) and receiving signals from the wireless communication devices 364 and/or the sensors 366. The wireless communication devices 364 are configured to send to and receive from various other electronic devices signals wirelessly (e.g., the electronic keys 245). The wireless communication devices 364 may, for example, include a transmitter and a receiver coupled to an antenna. The wireless communication devices 364 may communicate according to any suitable wireless communication protocol including, but not limited to, Wi-Fi, Bluetooth, and/or Bluetooth Low Energy (BLE). The sensors 366 are configured to detect various conditions, such as a magnetic field (e.g., including a compass or magnetometer), movement (e.g., including an accelerometer or gyroscope), and/or touch (e.g., capacitance, pressure). Additional ones of the sensors 366 are discussed in further detail below. The power source 368, such as a battery, is configured to provide electric power to the various other electronic components.

Figure 4:
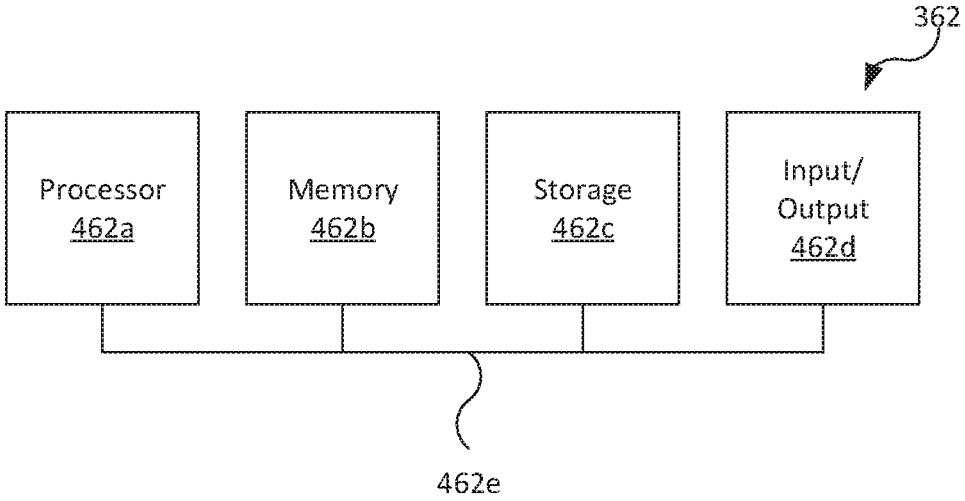
FIG. 4 is a schematic view of an example hardware configuration of a controller of the electronics of FIG. 3.

Referring to FIG. 4, an example hardware configuration of the controller 362 is shown. The controller 362 may be any computing device suitable for implementing the devices and methods described herein. In the example, shown, the controller 362 generally includes a processor 462*a*, a memory 462*b*, a storage 462*c*, an input/output 462*d*, and a bus 462*e* by which the other components of the controller 362 are in communication. The processor 462*a* may be any suitable processing device, such as a central processing unit (CPU), configured to execute instructions (e.g., software programming) The memory 462*b* may be a short-term, volatile electronic storage device, such as a random-access memory module (RAM). The storage 462*c* is a long-term, non-volatile electronic storage device, such as a solid-stated drive (SSD) or other computer-readable medium. The storage 462*c* stores therein instructions (e.g., the software programming), which are executed by the processor 462*a*. The input/output 462*d* is a communication device by which the controller 362 sends and receives signals, for example, to and from the wireless communication devices 364 and the sensors 366. The controller 362 may have any other suitable configuration, for example, being considered to include further processors and/or controllers (e.g., sub-controllers, or a system of controllers) that are associated with the different subsystems and/or sensors described herein (e.g., provided with a chip having one or more of the sensors).

Figure 5:
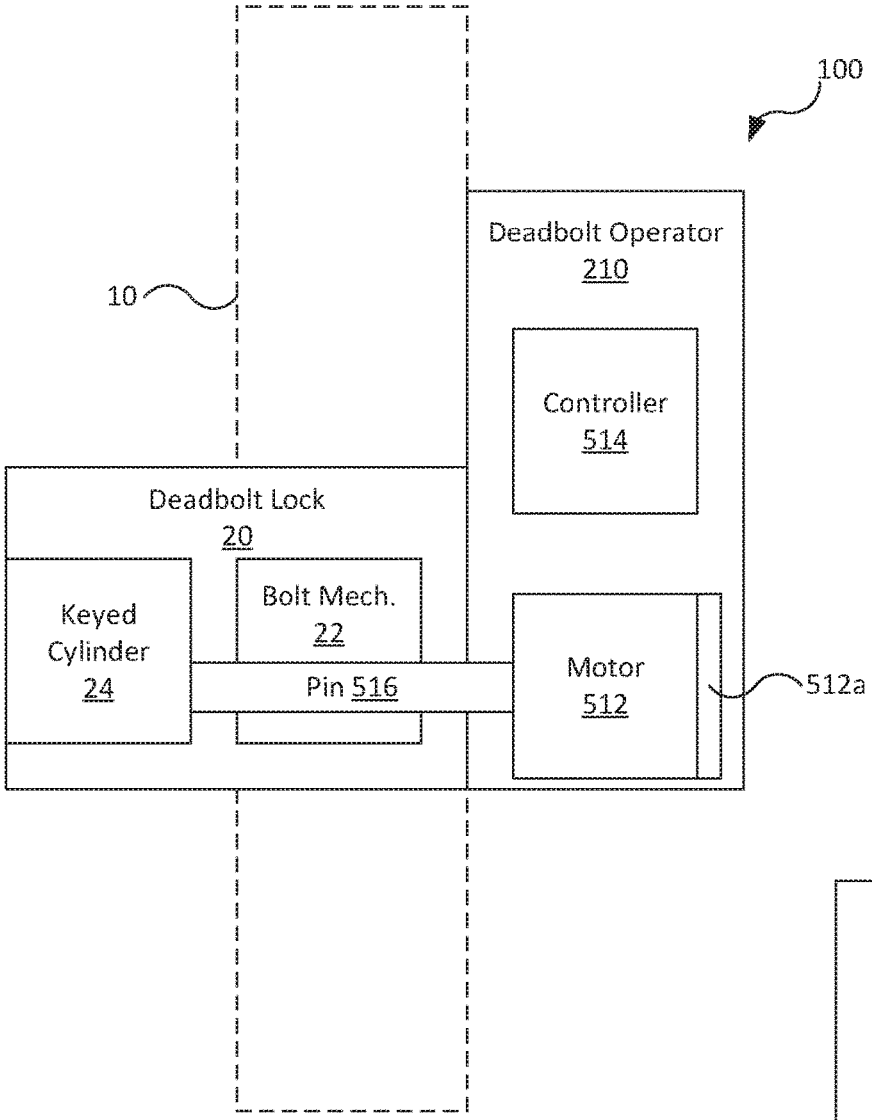
FIG. 5 is a schematic view of a deadbolt operator of the electronic door lock of FIG. 2.

Referring to FIG. 5, the electronic door system 100 may include the deadbolt operator 210. As illustrated schematically, the deadbolt operator 210 generally includes a motor 512 and a controller 514, and may further include or otherwise engage a pin 516 (e.g., a spindle, tailpiece, or cam bar). The motor 512 operatively engages the pin 516 to be rotated thereby, for example, having one or more gears arranged therebetween. The pin 516 operatively engages a deadbolt mechanism 22 of the deadbolt lock 20, such that rotation of the pin 516 by the motor 512 or by a keyed cylinder 24 (e.g., an external manual operator) of the deadbolt lock 20 operates the deadbolt mechanism 22 (e.g., causing extension and retraction thereof). The pin 516 may be provided as part of the deadbolt operator 210 (e.g., with the electronic door system 100), or may instead be provided as part of the deadbolt lock 20 and receivable by the deadbolt operator 210 (e.g., a receptacle that is rotatable by the motor 512). The controller 514 controls operation (e.g., rotation) of the motor 512 and, thereby, controls operation of the deadbolt lock 20. The controller 514 may be the controller 362 that functions to operate the door position assessor 250 and/or other subsystems of the electronic door system 100 or another controller. The deadbolt operator 210 may also be considered to include one or more of the sensors 366 for assessing operation of the deadbolt 20, such as a magnetic (e.g., hall sensor), optical sensor, or other type of sensor suitable for assessing whether the deadbolt 20 is in the extended position or the retracted position. Instead or additionally, the deadbolt operator 210 may be configured to determine whether the deadbolt operator 210 is capable of operating the deadbolt 20, for example, determining that the deadbolt 20 is not operable if after a certain duration of attempting to move the deadbolt 20 the deadbolt has not moved to the extended position (e.g., if the deadbolt 20 is engaging the door jamb) or if the motor 512 is drawing high electricity (e.g., current). Assessment of operation of the deadbolt 20 may be performed by the controller 514 in conjunction with the sensor 366 associated with the deadbolt operator 210.

Figure 6A:
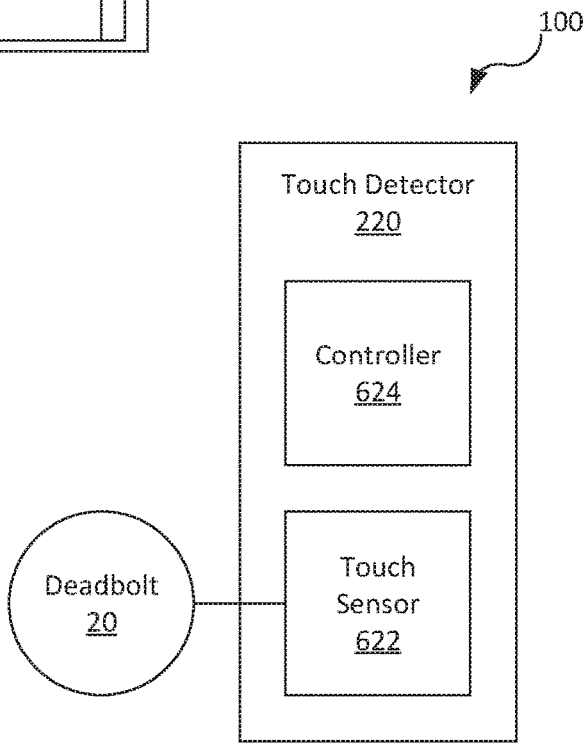
FIG. 6A is a schematic view of a touch detector of the electronic door system of FIG. 2.
Figure 6C:
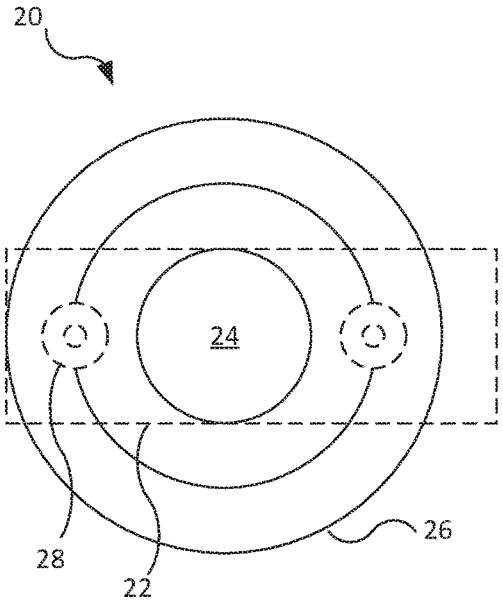
FIG. 6C is a front view of the deadbolt lock of FIG. 6B with hidden components depicted in dashed lines.
Figure 6D:
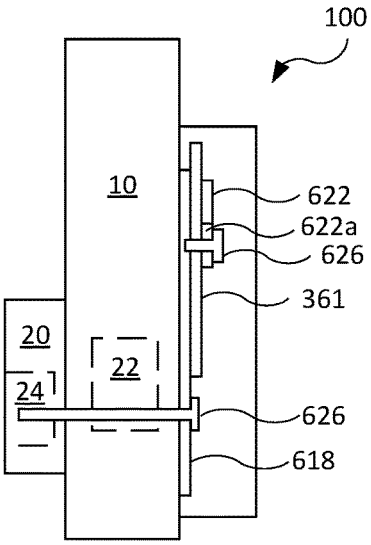
FIG. 6D is partial cross-sectional view of another embodiment of the electronic door system having the touch detector of FIG. 6A and being coupled to a door.
Figure 6B:
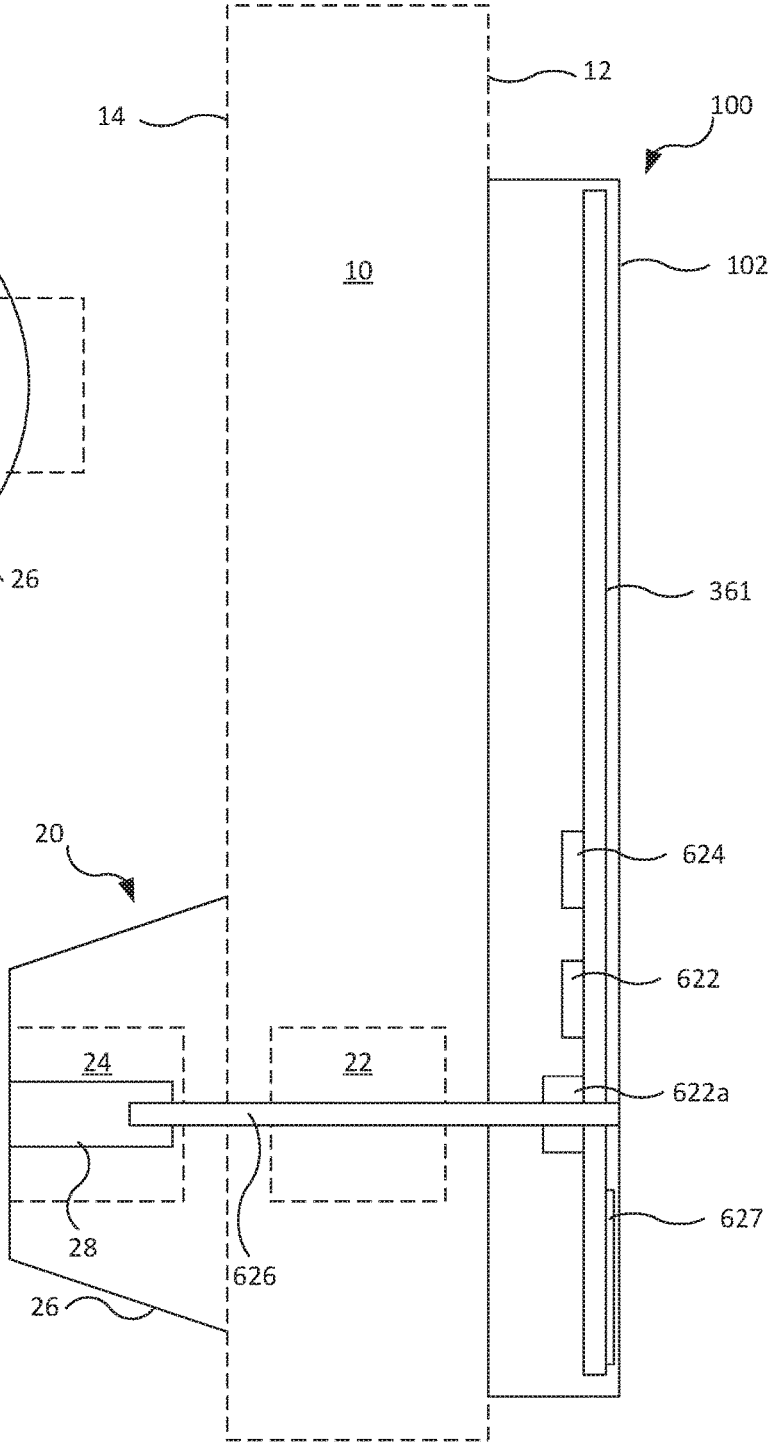
FIG. 6B is a partial cross-sectional view of the electronic door system having the touch detector of FIG. 6A and being coupled to a deadbolt lock and a door.

Referring to FIGS. 6A-6C, the electronic door system 100 may include the touch detector 220. The touch detector 220 is configured to detect touch, which may be indicative of a user's intent to unlock the deadbolt lock 20 to open the door 10. The touch detector 220 generally includes a touch sensor 622 and a controller 624. The touch sensor 622 is configured to sense touch on the exterior side 14 of the door 10. The controller 624 is electrically coupled to the touch sensor 622, so as to receive and interpret signals therefrom to determine whether a touch has been detected. In a preferred example, the touch sensor 622 is configured to measure capacitance, and the controller 624 determines touch based on the measured capacitance (e.g., if capacitance exceeds a threshold). The touch sensor 622 may be one of the sensors 366 that is used by and/or considered part of another subsystem (e.g., the door position assessor 250), while the controller 624 may be the controller 362 (or another controller).

The touch detector 220 is further configured to couple to the deadbolt lock 20 and utilize components thereof as a sensing component, which may be referred to as an electrode, for the touch detector 220. As a result, the electronic door system 100 may be used with an existing deadbolt lock 20 and detect touches thereof. More particularly, a deadbolt lock 20 of a conventional type will typically include an external housing 26 (e.g., a shroud or escutcheon) that surrounds the keyed cylinder 24 and provides access thereto with mechanical keys. The external housing 26 provides the deadbolt lock 20 with the aesthetics of the deadbolt lock 20 on the exterior side 14 of the door 10, for example, having different shapes and/or colors. The external housing 26 is generally made of or otherwise includes a conductive material (e.g., a metal).

The touch sensor 622 of the touch detector 220 is electrically coupleable to the external housing 26 of the deadbolt lock 20, such that the external housing 26 functions as an electrode of the touch sensor 622 whereby capacitance may be measured for detecting touch thereto. As shown in FIGS. 6B-6C, the touch sensor 622 is conductively coupled to the deadbolt lock 20 and, in particular, to the external housing 26 with a fastener 626 (e.g., a screw or other threaded fastener). The fastener 626 may further function to mount the deadbolt lock 20 to the door 10 and/or mount the electronic door system 100 to the door 10.

The deadbolt lock 20 includes mounting holes 28 (e.g., in conductive bosses) in the external housing 26 (as shown) or other structure (e.g., the keyed cylinder 24 or a mounting plate) that receive threaded fasteners for coupling the external housing 26 in a conventional arrangement with an internal operator (e.g., the thumb turn) and, thereby, mounting the deadbolt lock 20 to the door 10. The deadbolt mechanism 22 may further include apertures through which one or more of the threaded fasteners 626 may extend and/or are contacted by the fastener 626.

The touch sensor 622 includes a conductive contact 622*a* that is electrically coupled thereto (e.g., via the circuit board 361) and that conductively engages the fastener 626. As shown, the conductive contact 622*a* is a boss (e.g., a standoff) formed of a conductive material (e.g., metal) and through which the fastener 626 extends, but may be configured in other manners (e.g., a conductive spring member that engages the fastener 626. The fastener 626 extends through the door 10 and is received by the holes 28 and, thereby, conductively couples the touch sensor 622 to the deadbolt lock 20 and the external housing 26 thereof. Thereby, the external housing 26 of the deadbolt lock 20 is conductively coupled to the touch sensor 622 and functions as an electrode thereof for measuring capacitance.

The fastener 626 may further function to mount the deadbolt lock 20 (e.g., the external housing 26 and the deadbolt mechanism 22 to the door 10.

In one example, the fastener 626 may be in conductive contact with both the deadbolt lock 20 (e.g., the external housing 26 and/or the deadbolt mechanism 22), for example, extending directly therebetween.

In other examples, intermediate electrically conductive members may be arranged between the fastener 626 and the deadbolt lock 20 (e.g., the external housing 26) and/or the touch sensor 622 (e.g., the conductive contact 622*a*), while the fastener 626 is still considered to electrically conductively couple the touch sensor 622 to the deadbolt lock 20 to function as an electrode thereof. Such intermediate conductive members may, for example, include a washer or metal plate (e.g., a mounting plate, such as the mounting plate 618), For example, as illustrated in FIG. 5D, the deadbolt lock 20 (e.g., the external housing 26, the mounting holes 28, and/or the deadbolt mechanism 22) may be conductively coupled to the mounting plate 618 with one of the fasteners 626 (e.g., to mount the deadbolt lock 20 to the door 10, as with fasteners extending through the mounting plate 1018 and the bore of the door to the deadbolt 20), while the touch sensor 622 is electrically conductively coupled to the mounting plate with another of the fasteners 626 (e.g., extending through or otherwise conductively, engaging the conductive contact 622*a*, which may also mechanically couple the electronic door lock 10 to the door 14 via the mounting plate). In this scenario, the touch sensor 622 is electrically coupled to the deadbolt 20 serially via a first fastener 626, the mounting plate 618, and a second fastener 626.

As shown in FIG. 6B, the touch detector 220 may, instead of or in addition to the touch sensor 622, include an interior touch sensor 627, which may detect touch to the housing 102 of the electronic door system 100. The interior touch sensor 627 may measure touch (e.g., force or pressure thereto) or may be a proximity sensor that measures capacitance (e.g., through the housing 102). The interior touch sensor 627 may be one of the sensors 366. Upon detecting a touch (or touch gesture, such as a double tap) with the interior touch sensor 627, the deadbolt operator 210 may be operated to lock or unlock the deadbolt lock 20 irrespective of an electronic key 245. Gestures may be advantageous, so as to avoid performing operations based on inadvertent touches (e.g., bumping into by a person, or a pet touching the interior touch sensor 627).

Figure 7A:
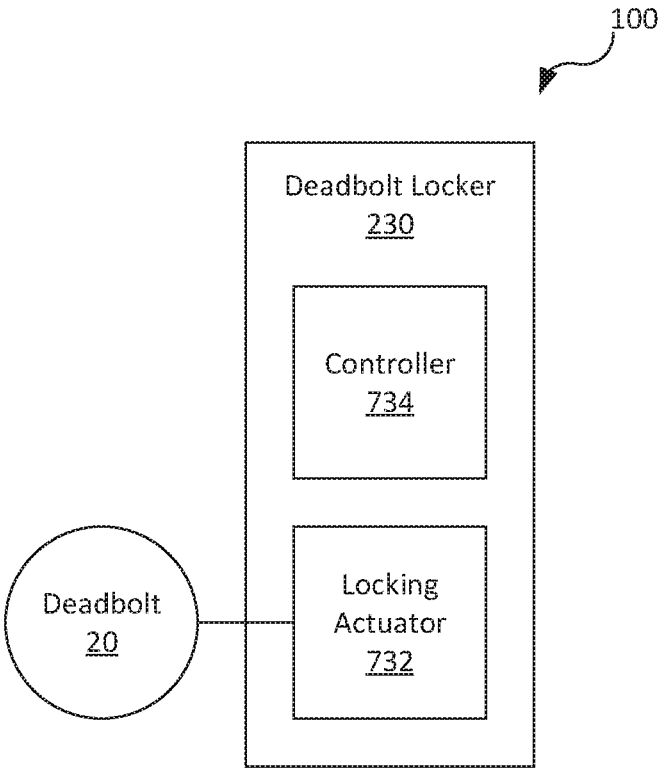
FIG. 7A is a schematic view of a deadbolt locker of the electronic door system of FIG. 2.
Figure 7B:
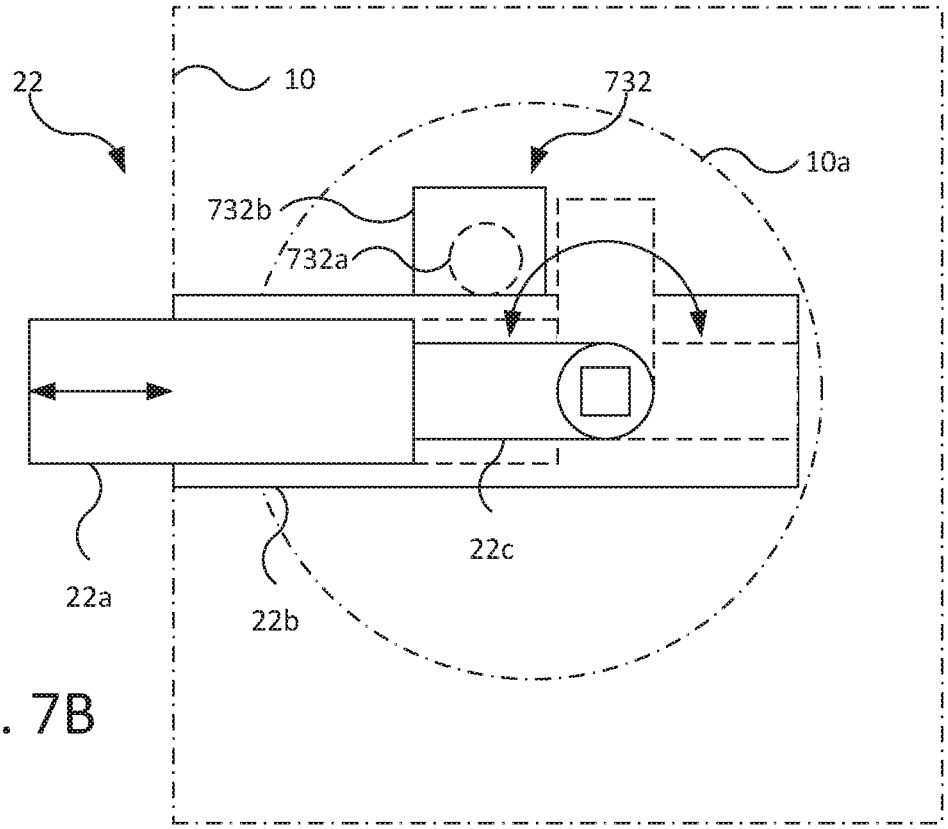
FIG. 7B is a partial cross-sectional view of the deadbolt locker and a deadbolt lock in a non-locking state.
Figure 7C:
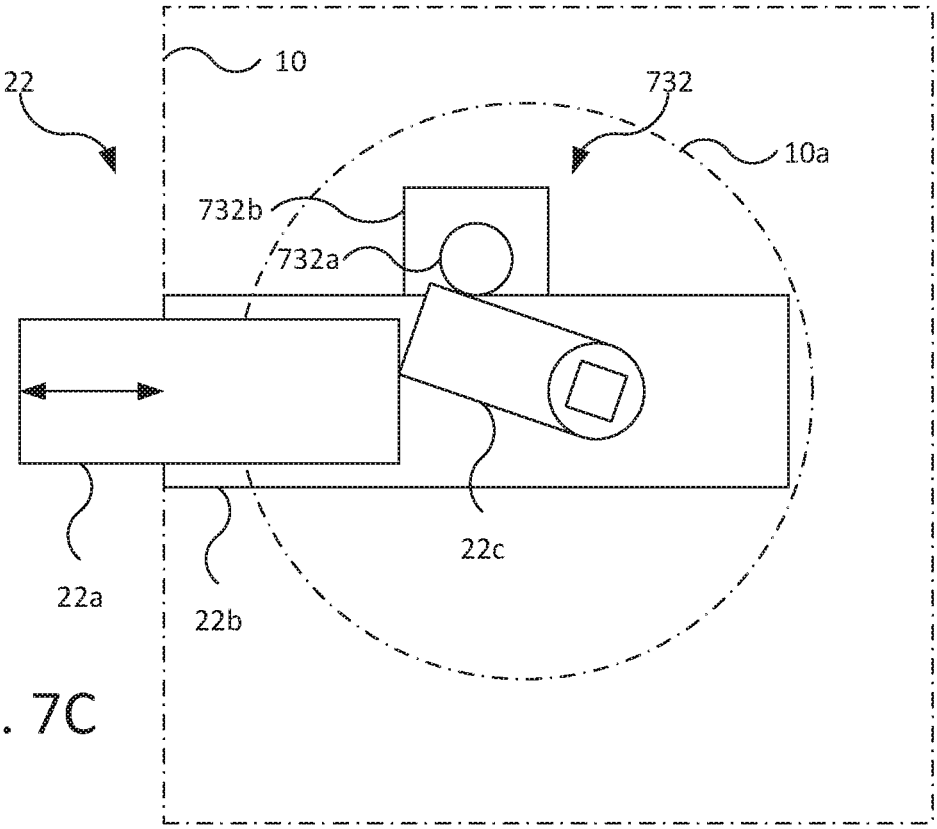
FIG. 7C is a partial cross-sectional view of the deadbolt locker and the deadbolt lock in a locking state.

Referring to FIGS. 7A-7C, the electronic door system 100 may include the deadbolt locker 230, which is a mechanical device that physically engages the deadbolt lock 20 (e.g., the deadbolt mechanism 22 independent of the pin 516) to prevent operation thereof (e.g., the deadbolt locker 230 mechanically blocks the deadbolt lock 20). The deadbolt locker 230 generally includes a locking actuator 732 and a controller 734. The locking actuator 732 engages the deadbolt mechanism 22 to prevent operation thereof, as discussed in further detail below, and the controller 734 controls operation thereof. The controller 734 may be the controller 362, for example, such that the same controller controls operation of the deadbolt operator 210, the touch detector 220, and the deadbolt locker 230, or may be another suitable controller. The deadbolt locker 230 may also be referred to as a lock blocking, lock jamming device, or anti-picking actuator.

As shown in FIGS. 7B and 7C, the deadbolt mechanism 22 of the deadbolt lock 20 generally includes a bolt 22*a*, a body 22*b*, and a locking arm 22*c*, which are positioned within a bore 10*a* of the door 10 (both illustrated in broken dash-dot lines). As the pin (e.g., the pin 516) is rotated, the bolt 22*a* is moved relative to the body 22*b* between an extended position (shown in solid lines) and a retracted position (shown in dashed lines). For example, a cam mechanism (not shown) may be arranged between the pin and the bolt 22*a*, whereby rotation of the pin causes movement of the bolt 22*a*. Furthermore, as the pin is rotated, the locking arm 22*c* rotates between a locking position (shown in solid lines) and a non-locking position (shown in dashed lines at two rotational positions). In the locking position, a distal end of the locking arm 22*c* engages an inner end of the bolt 22*a* to prevent retraction thereof into the body 22*b*. In the locking and non-locking positions of the locking arm 22*c*, the locking arm 22*c* is generally contained by the body 22*b* (e.g., being positioned below an upper edge thereof), while the distal end thereof extends above the body 22*b* when rotating therebetween.

The locking actuator 732 of the deadbolt locker 230 is configured to engage and, thereby, prevent movement of the locking arm 22*c* from the locking position to the non-locking position. Thereby, the distal end of the locking arm 22*c* remains engaged with the inner end of the bolt 22*a* to prevent retraction thereof. The locking actuator 732 includes, for example, a locking pin 732*a* and an actuator 732*b* (e.g., a motor or a solenoid). When the locking pin 732*a* is in a retracted position (e.g., indicated by dashed lines in FIG. 7B), the locking pin 732*a* is retracted toward the interior side 12 of the door 10 and, thereby, allows the locking arm 22*c* of the deadbolt mechanism 22 to rotate between the locking and non-locking positions. When the locking pin 732*a* is in an extended position (e.g., indicated by solid lines in FIG. 7C), the locking pin 732*a* is extended toward the exterior side 14 of the door 10 and is positioned above the locking arm to, thereby, engage and prevent rotation of the locking arm 22*c* from the locking position to the non-locking position thereof. The deadbolt locker 230 may further include a locking block (not shown or labeled) coupled to the locking pin 732*a* or otherwise movable by the locking actuator 732. The locking block, as compared to the locking pin 732*a*, may fill a larger space between the deadbolt mechanism 22 and the bore 10*a* of the door 10. Thus, as the locking arm 22*c* is attempted to be rotated, the locking arm 22*c* presses the locking block into the surface of the door 10 defining the bore 10*a*, thereby transferring force arising from the torque applied to the locking arm 22*c* from the locking block to the door. As a result, the locking actuator 732 may be required to bear only a nominal force in the radial direction of the locking pin 732*a*, while still preventing operation of the deadbolt lock 20.

Figure 8:
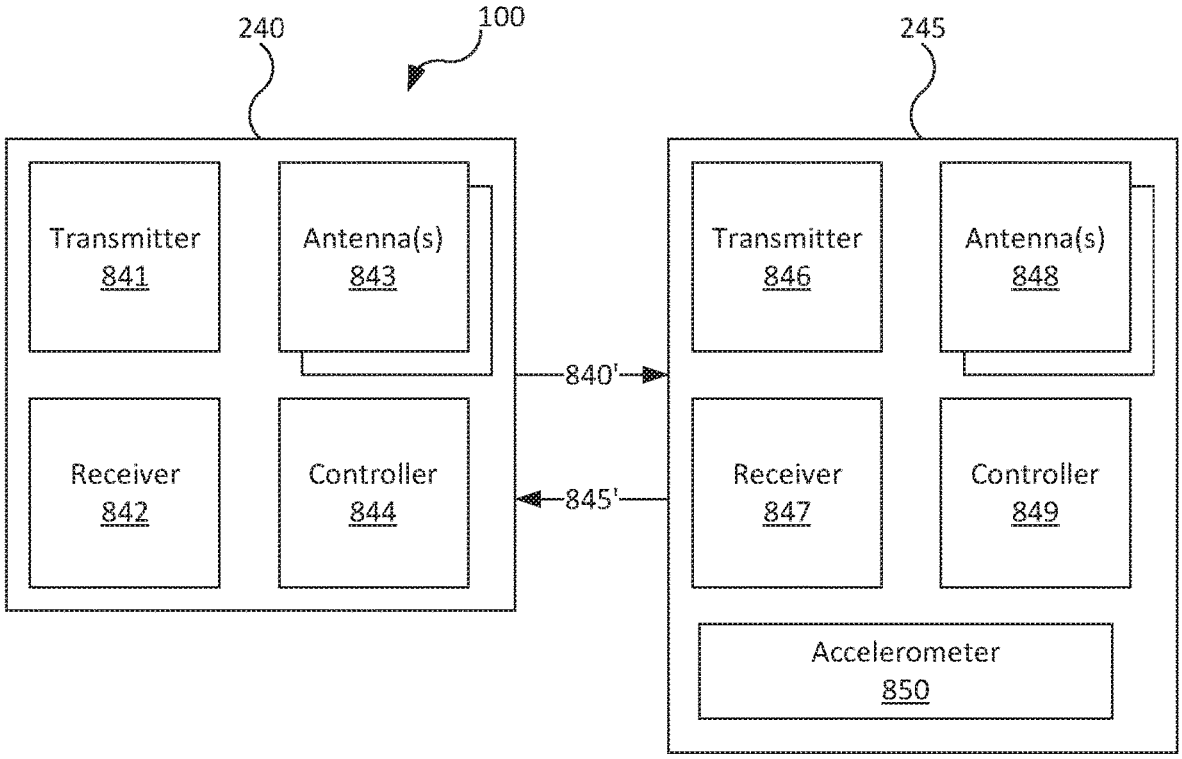
FIG. 8 is a schematic view of the electronic key detector in wireless communication with an electronic key.

Referring to FIGS. 8A-8B, the electronic door system 100 may include the electronic key detector 240. The electronic key detector 240 determines whether any of the electronic keys 245 that are associated with the electronic door system 100 is in a detection region, such as the exterior space 8 or subregion thereof. A key detection is a determination that an electronic key is within the detection region.

Referring to FIG. 8B, the electronic key detector 240 generally includes a transmitter 841, a receiver 842, and one or more antennas 843 coupled thereto, as well as a controller 844 that controls sending of signals with the transmitter 841 and interprets signals received by the receiver 842. The controller 844 may be the controller 362, which may be shared or considered part of other subsystems of the electronic door system 100, or may be another similarly configured controller. The electronic keys 245, similarly, each include a transmitter 846, a receiver 847, and one or more antennas 848 coupled thereto, as well as a controller 849 that controls sending of signals with the transmitter 846 and interprets signals received by the receiver 847. The electronic key 245 may also include an accelerometer 850.

The electronic key detector 240 may detect the electronic key 245 in one or more various different manners. In one example, the electronic key detector 240 sends a lock signal 840' (e.g., a first, challenge, or door signal) to a broadcast region that forms the detection region. The lock signal 840' may be sent, for example, in response to detecting touch with the touch detector 220. If the electronic key 245 is within the broadcast region and receives the lock signal 840' at sufficient strength, the electronic key 245 receives the lock signal 840' and sends a key signal 845' (e.g., a second signal) in response thereto, which is then received by the electronic key detector 240. The lock signal 740' may be encrypted or otherwise secured, such that only those electronic keys 245 associated with the electronic key detector 240 may decipher the lock signal 840' and send the key signal 845' in response thereto. Those electronic keys 245 in the detection region but not associated with the electronic key detector 240 may not interpret (e.g., decrypt) the lock signal 840' and, therefore, will not send the key signal 845' in response thereto. Further, the electronic key detector 240 may filter out any of the key signals 845' that are received below a given signal strength (e.g., suggesting the electronic key 245 is outside the detection region). Still further, the key signal 845' may contain acceleration data from the accelerometer 850 of the electronic key 245 and may filter out any of the key signals 845' having acceleration data indicating no movement of the electronic key 245 (e.g., in case the electronic key 245 is inadvertently left on a stable surface in the detection region). The key signal 845' may also be encrypted, so as to only be decipherable by the electronic door system 100 associated with the electronic key 245. The lock signal 840' may further include identifying information, such as a username or unique alphanumeric code), which may enable the electronic key detector 240 to decipher between those electronic keys 245 associated therewith (e.g., electronic keys 245 of different users for which access through the door 10 should be permitted).

The electronic key 245 may be a dedicated purpose device (e.g., only functioning as an electronic key for use with the electronic key detector 240), or may be another multi-purpose device with suitable hardware and software (e.g., a smartphone) for receiving and deciphering the lock signal 840' and sending the key signal 845' in response thereto.

Figure 9A:
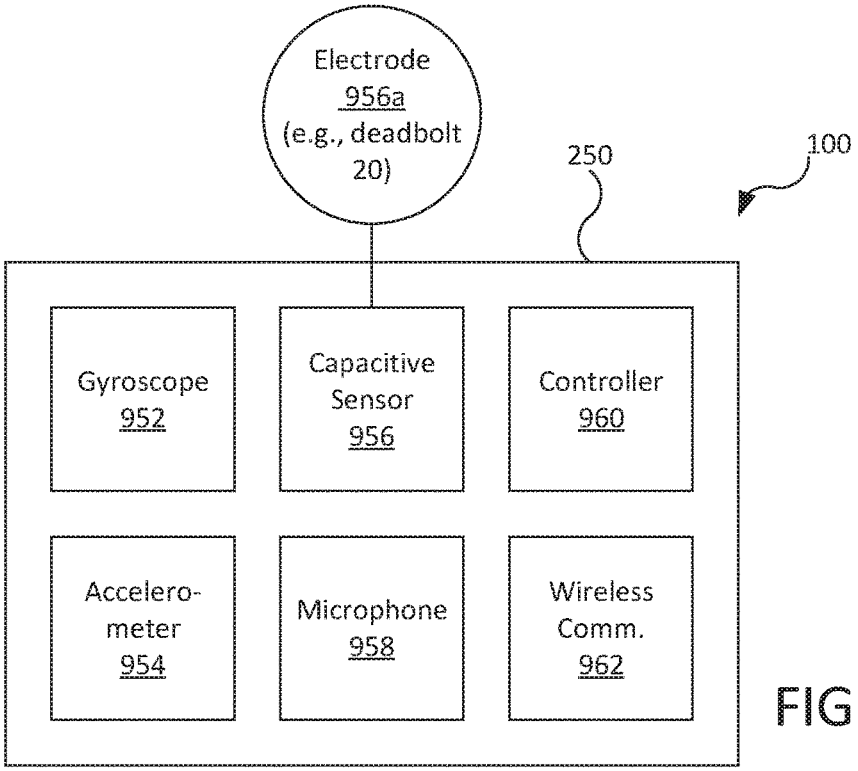
FIG. 9A is a schematic view of a door position assessor of the electronic door lock of FIG. 1.
Figure 9B:
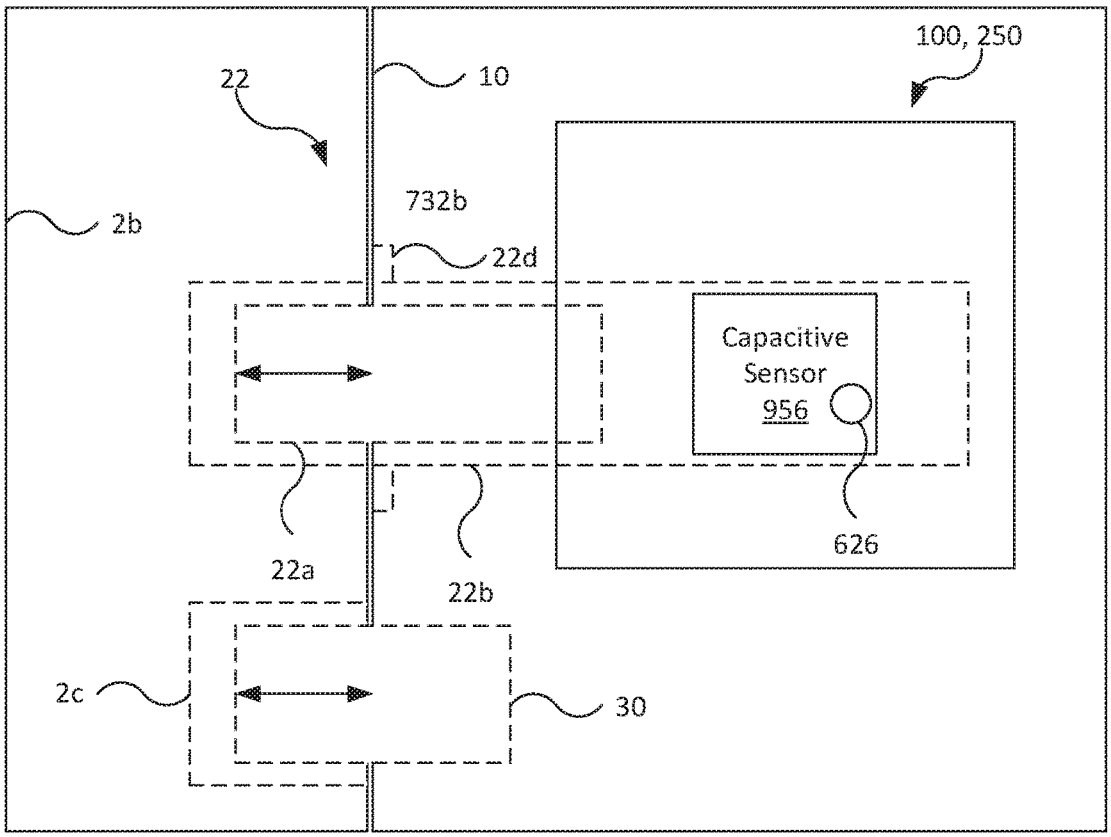
FIG. 9B is a partial view of the door position assessor with a door and building structure.

Referring to FIGS. 9A and 9B, the electronic door system 100 includes the door position assessor 250 that, as referenced previously, assesses the physical position of the door 10, for example, to determine whether the door 10 is closed and/or an angular position assessment. The door position assessor 250 includes one or more sensors for sensing one or more door position conditions that are indicative of the physical position of the door 10 and according to which the door position assessor 250 assesses the physical position of the door 10. As shown, the sensors of the door position assessor 250 may include one or more of a gyroscope 952, an accelerometer 954, a capacitive sensor 956, or a microphone 958. The door position conditions are physical conditions that are observable with the sensors. As discussed in further detail below, the door position conditions include angular velocity or position of the door 10 sensed by the gyroscope 952, linear acceleration of the door 10 sensed by the accelerometer 954, capacitance of the building structure 2 sensed by the capacitive sensor 956, or sound of the door 10 closing sensed by the microphone 958. The door position assessor 250 also includes a controller 960 and may include a wireless communication device 962.

The electronic door system 100 is contemplated to assess the physical position of the door 10 according various different combinations of the door position conditions, including: the angular velocity or position (e.g., determined with the gyroscope) alone or in combination with any one, two, or three of the acceleration, capacitance, or sound; the acceleration alone or in combination with any one or two of the capacitance or sound; the capacitance alone or in combination with the sound; and the sound alone.

The sensors of the door position assessor 250 (i.e., the one or more of the gyroscope 952, the accelerometer 954, the capacitive sensor 956, and the microphone 958) may be one of the sensors 366 of the electronic door system 100, which may also be used by (e.g., are components shared with) other subsystems of the electronic door system 100 (e.g., of the deadbolt operator 210, the touch detector 220, the deadbolt locker 230, or the electronic key detector 240). The controller 960 and the wireless communications device 962 may be the controller 362 and the wireless communication device 364, which may also be used by (e.g., are components shared with) other subsystems of the electronic door system 100 (e.g., of the deadbolt operator 210, the touch detector 220, the deadbolt locker 230, or the electronic key detector 240).

Multiple different door position conditions may be used to assess the physical position of the door 10. The use of additional door position conditions may advantageously provide greater accuracy and/or reliability to the assessment of the physical position of the door 10 by providing confirmation or otherwise increasing the overall confidence in the assessment of the physical position of the door 10. For example, while different ones of the sensors may be subject to errors (e.g., calibration, noise, resolution, drift) and the door position conditions may be subject to false positives (e.g., sensed door position conditions that would otherwise satisfy criteria for determining that the door 10 is in the closed physical position), the use of additional and different door position conditions may account for such sensor errors or inaccuracies and false positive scenarios to provide accurate assessments of the physical position.

The angular physical position of the door 10 refers to the actual angle of the door 10 relative to a reference position. The reference position may, for example, be the closed physical position of the door 10, such as when closing off the door opening 4 of the building structure 2 and/or that where the deadbolt lock 20 can be operated to couple the latch edge 18 of the door 10 to the building structure 2. The reference position may be assigned a value of zero degrees. The reference position may be established during a setup operation for the particular door and building combination with which the electronic door system 100 is used.

The gyroscope 952 may be a single-axis gyroscope or, alternatively, a three-axis gyroscope that measures angular velocity about a first axis that is the hinge axis, a second axis that parallel to the plane 11 of the door 10 (e.g., an X-axis), and a third axis that is perpendicular to the plane 11 of the door 10 (e.g., a Y-axis). Alternatively, the one or more axes of the gyroscope 952 may be arranged in different axes from which the angular velocity and, thereby, the angular position of the door 10 about the hinge axis may be determined. The gyroscope 952 may, for example, be a micro-electronic mechanical system-type (MEMS) gyroscope. The gyroscope 952 may also be considered to include separate components (e.g., MEMS-gyroscopes) that measure angular velocity of the door 10 about the hinge axis and/or other axes.

The door position assessor 250 calculates an angular position assessment of the door 10 from the physical angular velocity of the door 10. The physical angular velocity of the door 10 is sensed by the gyroscope 952, which is coupled to the door 10 as part of the electronic door system 100. The angular position assessment of the door 10 is a cumulative calculation from the physical angular velocities measured by the gyroscope 952 over time. The angular position assessment may be calculated in any suitable manner, such as the sum of products of the measurements of angular velocity and the period between such measurements. The angular position assessment may be expressed in any suitable manner, such as an angular value, proxy thereto, or other value representative of an angular value. The physical angular velocity is measured about the hinge axis of the door 10, which, as described previously, is vertical and may be referred to as the Z-axis. The angular position assessment of the door 10, being calculated from the angular velocity about the Z-axis, is also determined about the Z-axis.

The angular position assessment of the door 10 is subject to inaccuracy as compared to the physical angular position, which may arise due to inaccuracies or errors in the measurement of the physical angular velocity of the door 10 by the gyroscope 952. Further, because the angular position assessment is a cumulative calculation from the physical angular velocity, the angular position assessment may magnify those inaccuracies or errors of the gyroscope 952 over time. Inaccuracies and errors of the gyroscope 952 may include, for example, include calibration, noise, resolution, and/or drift errors as referenced above.

Various strategies may be used to reduce or otherwise account for the inaccuracy of the angular position assessment. First, the angular position may be calculated from physical angular velocity measurements taken substantially only when the door 10 is moving, as may be determined with the accelerometer 954, as discussed below. This removes inaccuracies in the angular position assessment related to errors of non-zero measurements of physical angular velocity taken while the door 10 was not moving. Second, the angular position assessment may be reset to a reference value (e.g., zero degrees) with each determination that the door is in a reference position (e.g., the closed physical position). This removes any previously accumulated error in the angular position each time the physical door position is assessed to be in the reference position. Third, the other door position conditions may be used as additional criteria for assessing the physical position of the door 10. This removes inaccuracies otherwise associated with relying solely or directly on the angular position assessment arising from the gyroscope 952 measurement errors.

The linear acceleration of the door 10 refers to physical linear acceleration of the door 10. The physical linear acceleration of the door 10 is measured with the accelerometer 954, which is coupled to the door 10 as part of the electronic door system 100. The accelerometer 954 senses or measures physical linear acceleration of the door 10 in the X-axis (i.e., perpendicular to the plane 11 of the door 10) and/or the Y-axis (i.e., horizonal and parallel with the plane 11 of the door 10).

The accelerometer 954 may, for example, be a three-axis accelerometer that measures linear acceleration in X-axis, Y-axis, and the Z-axis (i.e., the hinge axis). Alternatively, the accelerometer 954 may measure acceleration in different directions from which acceleration in the X-axis and the Y-axis may be calculated. The accelerometer 954 may, for example, be a micro-electronic mechanical system-type (MEMS) accelerometer. The accelerometer 954 may be provided as a singular component (e.g., a common chip) with the gyroscope 952. The accelerometer 954 may also be considered to include separate components (e.g., MEMS accelerometer devices) that measure linear acceleration of the door 10. The accelerometers 954 may be provided as a common component (e.g., chip) with the gyroscope 952.

The physical linear acceleration in the X-axis (i.e., perpendicular to the plane 11 of the door 10) may indicate that the door 10 has been closed and, therefore, is in the closed physical position. As the door 10 is closed, the latch edge 18 of the door 10 may accelerate in the X-axis in a repeated pattern, which is referred to herein as the door closing acceleration profile and, when later detected, indicates that the door 10 may have been closed. In one example, which may be characteristic of many different combinations of doors 10 and building structures 2, the door closing acceleration profile includes at least two characteristic features of a first peak acceleration in an opening direction (i.e., opposite the direction to which the door 10 is moved into the closed physical position), and a second peak acceleration in a closing direction (i.e., the same direction as which the door 10 is moved to the closed physical) and having a lower magnitude than the first peak acceleration. The first peak acceleration represents the door 10 engaging in the closing direction a door stop of the building structure 2 on the latch-side jamb 2*b* and rebounding therefrom in the opening direction. The second peak acceleration represents a spring latch 30 (e.g., of a conventional door knob mechanism; not shown) engaging in the opening direction a corresponding latch receptacle 2*c* of the latch-side jamb 2*b* (e.g., of a corresponding strike plate) and rebounding therefrom in the closing direction. The door closing acceleration profile may also include a third peak acceleration that occurs temporally between the first peak acceleration and the second peak acceleration in the opening direction at a lower magnitude than the first peak acceleration.

The physical linear acceleration of the door 10, as measured by the accelerometer 954, may be assessed in any suitable manner for assessing the physical position of the door 10 and, in particular, whether the door 10 is in the closed physical position. For example, the X-axis acceleration may be determined to indicate that the door 10 is in the closed physical position upon a favorable comparison of the X-axis acceleration measurements with the door closing acceleration profile as described above or otherwise determined for a particular combination of the door 10 and the building structure 2. Comparisons may, for example, be performed between directional patterns and/or magnitudes (e.g., ranges) of measured peak accelerations and those of the door closing acceleration profile and/or with any suitable pattern recognition technique, such as a machine learning technique. The door closing acceleration profile may be predetermined (e.g., as described above), determined during an initial setup operation (e.g., opening and closing the door repeatedly while X-axis acceleration measurements are taken), and/or adjusted over time (e.g., to account for physical changes of the door 10 and the building structure 2, such as from changes in humidity, temperature, and/or wear).

Linear acceleration in the Y-axis (i.e., horizontal and parallel to the plane 11 of the door 10) may indicate that the door 10 is moving. Because the door 10 rotates about the hinge-axis, acceleration parallel with the plane 11 of the door 10 is positive due to centripetal force whenever the door 10 is moved. The linear acceleration of the door 10 in the Y-axis, as measured by the accelerometer 954, maybe used to reduce errors in calculating the angular position assessment from the angular velocities measured by the gyroscope 952 over time (e.g., if the angular velocity is measured as non-zero when not moving), as was described previously. For example, either the gyroscope 952 is not operated when Y-axis acceleration is not detected, thus also saving power consumption, or the angular velocities measured when acceleration was not detected in the third axis are simply not used to determine the angular position assessment.

The capacitance measured from the door 10 refers to capacitance of the building structure 2 that is measured by the capacitive sensor 956 of the door position assessor 250. Stated differently, the capacitive sensor 956 capacitively senses the building structure 2. Detected capacitance may indicate that the door 10 is in the closed physical position. For example, capacitance of the building structure 2 sensed by the capacitive sensor 956 may be expected to be within a certain range and/or remain at a generally constant magnitude when the door 10 is in the closed physical position. This range of capacitance may be referred to as a closed-door capacitance value or range and form a capacitance criterion. The closed door capacitance value be different between different combinations of doors 10 and building structures 2 and, may, accordingly be determined during an initial setup process of the door position assessor 250 with a particular combination of the door 10 and the building structure 2 and/or updated over time (e.g., as temperature, humidity, and wear change spacing between the door 10 and the building structure 2 in the closed position). In some combinations of doors 10 and building structures 2, the capacitance of the building structure 2 may not be detectable or may not be sufficiently distinguishable from sensor error or other sources of capacitance. In such circumstances, the capacitance of the building structure 2 may not be a reliable indicator of whether the door 10 is in the closed physical position and, accordingly, may not be measured or processed when assessing the physical position of the door 10.

Referring to FIGS. 9A and 9B, the capacitive sensor 956 may include, or be coupleable to, an electrode 956*a* (e.g., the deadbolt 20) that is positioned near the latch edge 18 of the door 10. For example, the electrode 956*a* may be positioned on the latch edge 18 of the door 10, such that when the door 10 is in the closed physical position, the capacitive sensor 956 senses the capacitance of the building structure 2. For example, as the door 10 is moved toward the closed position, the capacitance sensed by the capacitive sensor 956 may increase as the electrode 956*a* is moved into close proximity of the building structure 2. In one example, the deadbolt lock 20 (e.g., the bolt mechanism 22, such as a bolt 22*a* and/or a strike plate 22*d* thereof) is electrically coupled (e.g., conductively coupled) to the capacitive sensor 956 and functions as the electrode 956*a* thereof (e.g., with the fastener 626, as described above with respect to the touch sensor 622).

It should be noted that in embodiments having the touch detector 220, the capacitive sensor 956 may be the same as the touch sensor 622 (e.g., the capacitive sensor 956 and the touch sensor 622 are the same sensor) or be a separate therefrom. In those embodiments in which both the door position assessor 250 and the touch detector 220 utilize the same capacitive sensor, the capacitance values of the building structure 2 (i.e., for the door position assessor 250) and of users (i.e., for the touch detector 220) are generally expected to be in non-overlapping ranges, have distinguishable patterns (e.g., generally constant values vs. momentary or fluctuating values, respectively), and/or occur in different angular positions of the door 10 (e.g., building capacitance sensed at less than 5, 3, 2, or 1 degrees), such that the electronic door system 100 is able to distinguish between capacitance of the building structure 2 and capacitance of a user. Further, for those embodiments in which both the door position assessor 250 and the touch detector 220 utilize the same capacitive sensor, the deadbolt lock 20 may function as the electrode for both the door position assessor 250 and the touch detector 220.

The sound sensed from the microphone 958 refers to sound from the door 10 moving into the closed position (e.g., engaging and coupling to the building structure 2). Detected sound may indicate that the door 10 has been closed, or has been opened, for example, if the sensed sound compares favorably to a previously-determined sound profile (e.g., using feature extraction and/or pattern recognition).

The sound, as sensed by the microphone 958, may be assessed in any suitable manner for assessing the physical position of the door 10 and, in particular, whether the door 10 has been closed and/or opened (e.g., using suitable audio recognition techniques). The audio signature of the door 10 closing and/or opening may be determined during an initial setup operation (e.g., opening and closing the door repeatedly while X-axis acceleration measurements are taken) and/or adjusted over time (e.g., to account for physical changes of the door 10 and the building structure 2, such as from changes in humidity, temperature, and/or wear).

Figure 10:
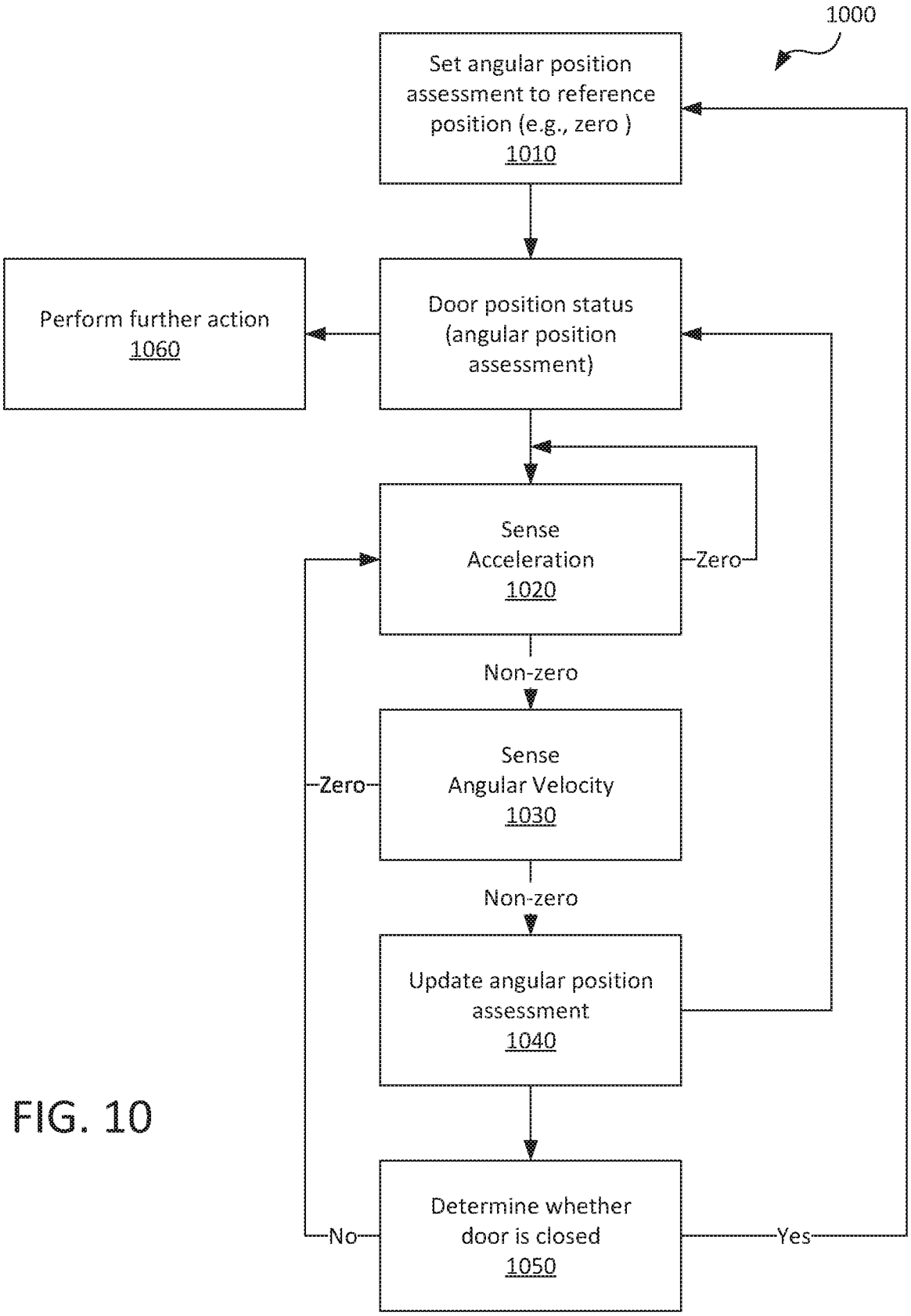
FIG. 10 is a flow chart of a method for assessing a position of a door.
Figure 11:
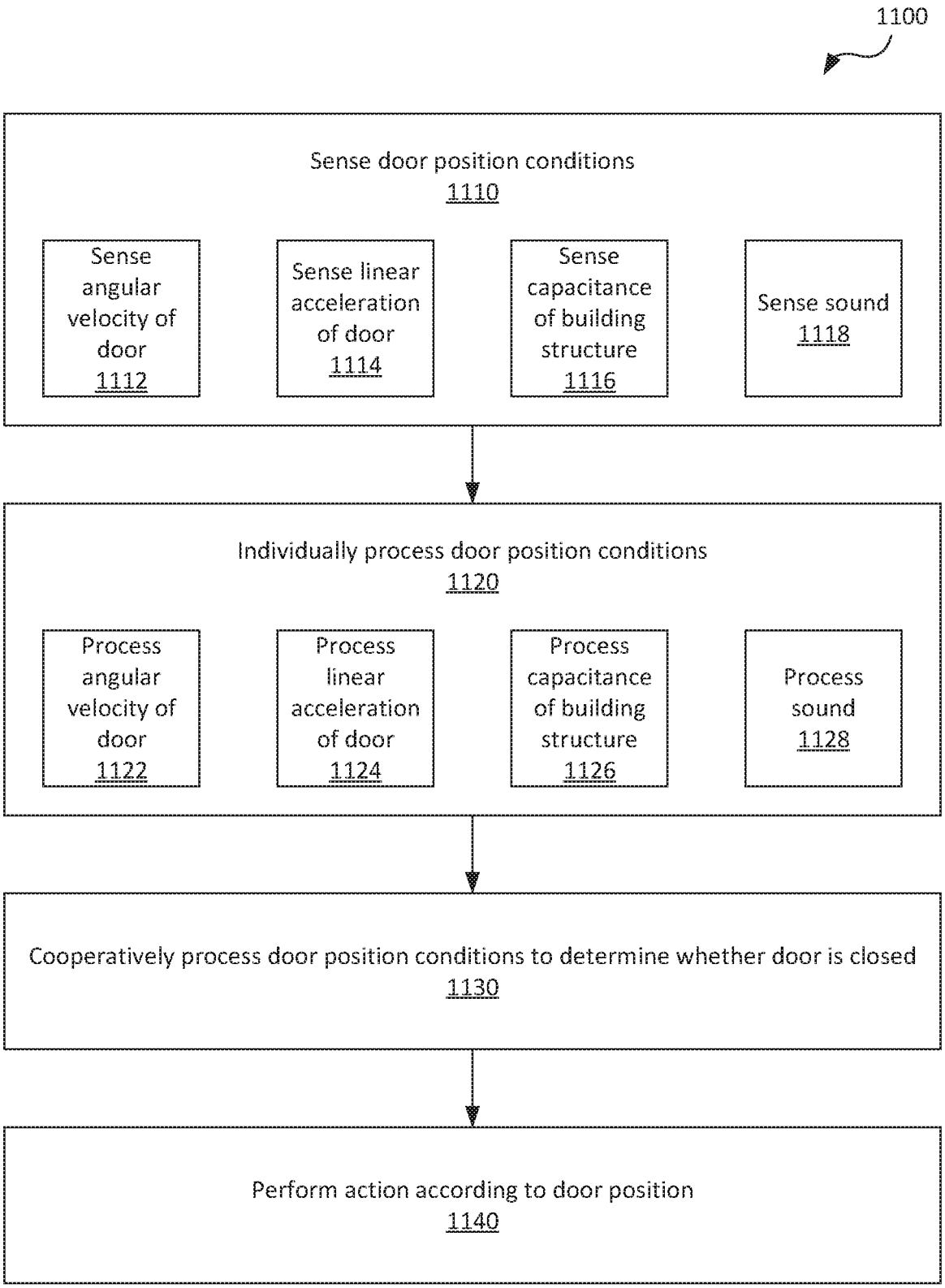
FIG. 11 is a flow chart of a method for assessing whether a door is closed.
Figure 12:
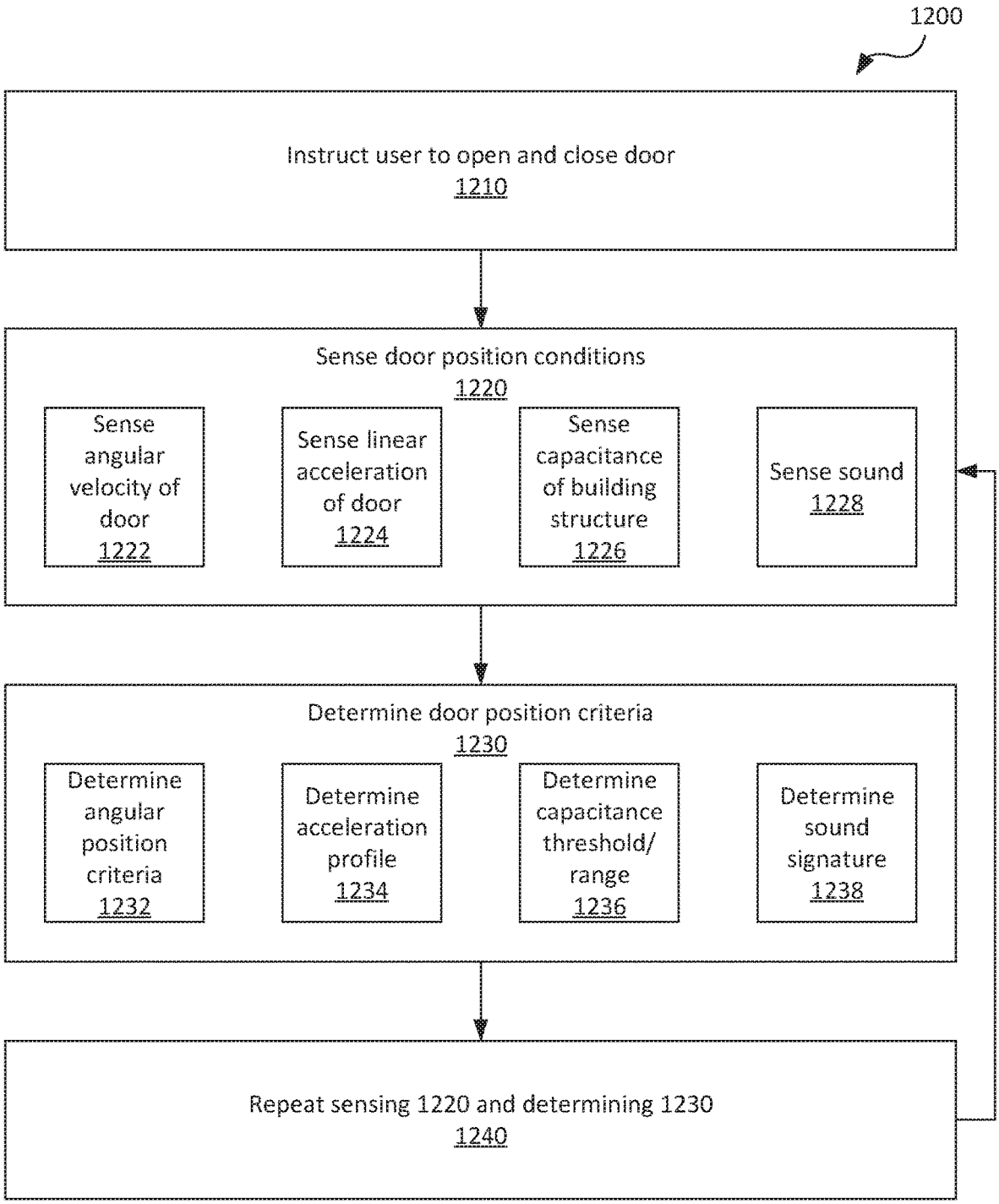
FIG. 12 is a flow chart of a method for determining criteria according to which a door is assessed to be closed.

Referring to FIGS. 10-12, the electronic door system 100 and, in particular, the door position assessor 250 implements one or more methods for assessing the physical position of the door 10. As described above, the physical door position may be assessed according to one or more of the sensors (e.g., the gyroscope 952, the accelerometer 954, the capacitive sensor 956, or the microphone 958) and/or according to one or more of the door position conditions (i.e., the angular velocity or angular position of the door 10, acceleration of the door 10 perpendicular to the plane 11 thereof, capacitance of the building structure 2, or sound of the door 10 closing). Door position conditions may also include operation of the deadbolt 20 with the deadbolt operator 210, such as whether the deadbolt 20 is in the extended position or retracted position, or whether the deadbolt operator 210 is able to move the deadbolt 20 into the extended position, which may be used in conjunction with one or more of the other door position conditions to assess the physical position of the door 10. By using more than one of the sensors and/or more than one of the door position conditions, the door position assessment may more accurately and/or reliably reflect the physical position of the door 10, including whether the door 10 is closed (i.e., is in the closed physical position). When assessing the physical door position with multiple of the door position conditions, the multiple door position conditions may be assessed in different manners, as discussed below. Further, the various sensing operations described herein may be considered to include appropriate signal processing of sensor data (e.g., to remove noise from the sensor output), outputting sensor data that includes information about the door conditions from the sensor (e.g., by sending a sensor data signal), and storing the sensor data (e.g., for processing or storage), which may be performed by a processor, such as the controller 960.

Referring to FIG. 10, a flow diagram is illustrated for a method 1000 of assessing the physical position of a door, such as the door 10 of the building structure 2. The method 1000 is implemented with a processor, such as the controller 960, and appropriate sensors, as described above and in further detail below. For example, the various assessments, determinations, and calculations are performed with the controller 960, and the various sensing and measuring are performed with the sensors as may be operated by the controller 960. In one example, the method 1000 is implemented with the electronic door system 100 and, in particular, the door position assessor 250 thereof.

The method 1000 generally includes setting 1010 the angular position assessment to a reference value, sensing acceleration 1020, sensing angular velocity 1030, calculating 1040 an angular position assessment, determining 1050 whether the door is closed (i.e., is in the closed physical position), and performing 1060 a further action according to the door position status.

The setting 1010 of the angular position assessment to the reference value may include setting an initial value or be performed in response to a prior determination that the door is in the closed physical position (e.g., to reset the angular position assessment to the reference value). The angular position assessment may be expressed in any suitable manner, such as radians or degrees. The reference position may, for example, be zero (e.g., zero degrees or zero radians). The setting 1010 is performed with a processor, such as the controller 960.

The sensing of acceleration 1020 is performed with the accelerometer 954, which may be operated by a processor (e.g., the controller 960). The sensing of acceleration 1020 includes sensing or otherwise determining acceleration horizontally and in the plane 11 of the door 10 (i.e., in the Y-axis), which indicates movement (i.e., rotation) of the door 10 about the hinge axis (i.e., the Z-axis). The sensing of acceleration may also include sensing acceleration perpendicular to the plane 11 of the door 10 (i.e., the X-axis), nonzero measurements of which may also indicate movement of the door 10.

If linear acceleration is not detected (e.g., if acceleration in the Y-axis is zero), the sensing of acceleration 1020 is continued to be performed, while the position status, including the angular position assessment, is not changed (e.g., the position status remains closed or open with the angular position assessment remaining at the reference value or other previously-determined value).

If linear acceleration is detected (e.g., if acceleration in the Y-axis is non-zero), the sensing of angular velocity 1030 of the door 10 is performed. The sensing of angular velocity 1030 is performing with the gyroscope 952, which may be operated by a processor (e.g., the controller 960).

If the angular velocity is measured at zero, the position status is not changed (e.g., the position status remains closed or open with the angular position assessment remaining at the reference value or other previously-determined value).

If the angular velocity is measured as non-zero, the calculating 1040 of the angular position assessment is performed with a processor, such as the controller 960. The position status is updated at 1040 with the angular position assessment being calculated according to the measured angular velocity. A change in the angular position assessment may be calculated as a summation of the products of the angular velocity measurements and the period between such measurements, or according to any other suitable method (e.g., integration), which is added to the current angular position assessment (e.g., the reference value or the previously-calculated angular position assessment). The position status may also be changed from closed to open, though a non-zero angular position assessment may also be considered to be an open position status. The angular position assessment is continually updated as described for 1020 and 1030 (i.e., if acceleration is non-zero at 1020, angular velocity is assessed; if angular velocity is non-zero at 1030, the angular position assessment is updated with the change calculated as described above). The angular position assessment is, therefore, a cumulative calculation based on the measured angular velocity over time, which may include multiple separate intervals.

By assessing the angular position only when acceleration is detected, either by continuously measuring the angular position but assessing only when acceleration is detected, or by measuring the angular velocity only when acceleration is detected, various measurement errors of the gyroscope 952 (e.g., non-zero measurements when the door 10 is not moving) are not accumulated in the angular position assessment.

The determining 1050 of whether the door 10 is closed (e.g., is in the closed physical position) is performed with a processor, such as the controller 960. The determining 1050 may be performed in various different manners and according to one or more of the sensors described previously (e.g., the gyroscope 952, the accelerometer 954, the capacitive sensor 956, or the microphone 958) and/or the door position conditions described previously (e.g., the angular velocity or position, acceleration profile, capacitance of the building structure 2, or sound profile). Various techniques and methods for assessing whether the door 10 is closed are discussed in further detail below with reference to FIG. 11.

If the physical position of the door 10 is not determined to be closed, the angular position assessment is continually updated at 1040 (e.g., proceeding through 1020, 1030, and 1040 as described previously).

If the physical position of the door 10 is determined to be closed, the setting 1010 of the angular position assessment is performed (i.e., the angular position assessment is reset to the reference value). The angular position assessment may be reset to the reference value irrespective of the current angular position assessment. For example, the previous angular position assessment may be non-zero due to the sensor errors described previously (e.g., calibration, noise, resolution, or drift of the gyroscope 952), while the angular position assessment is reset to the reference position to eliminate previously accumulated errors in the current angular position assessment.

At 1060, a further action is performed according to the position status and/or angular position assessment. For example, the position status and/or angular position assessment may be transmitted (e.g., with the wireless communication device 962) to provide notification to a user (e.g., homeowner, security monitoring company, or municipality). In the case of the electronic door system 100 including other subsystems, such as the deadbolt operator 210, the further action may include a physical operation (e.g., operating the deadbolt operator 210 to lock the door 10 only when the door status is closed, such as by not operating the deadbolt operator 210 when the angular position is non-zero, such as 1, 2, 3, or more degrees). The further action may be based on other conditions, such as a sequence or combination of conditions at different times. In once example, if the door 10 is first determined to be in the closed position with the deadbolt 20 in the extended position, and subsequently determined to be in the open position with the deadbolt 20 not having moved from the extended position (e.g., if the door 10 were down by an intruder), the further action may include providing an alert of a break-in event (e.g., a visual alert, audible alert or siren, and/or notification to a user).

Various techniques and methodologies may be used to assess whether the door 10 is closed (e.g., is in the closed physical position), which may be performed at 1050 in the method 1000, or may be performed independent of the method 1000. As referenced above, the physical position of the door 10, including whether the door 10 is in the closed physical position, may be assessed using one or more multiple different door sensors and/or one or more multiple door position conditions sensed thereby.

Referring to FIG. 11, a flow diagram is illustrated for a method 1100 of assessing whether the door 10 is closed (e.g., is in the closed physical position). The method 1100 generally includes sensing 1110 one or more door conditions, individual processing 1120 of the one more door conditions to determine whether the door 10 is closed, cooperatively processing 1130 two or more of the door conditions to determine the door status, and performing 1140 a further action according to the door status. As discussed in further detail below, the individual processing 1120 of the door conditions may be performed in independent and/or combined manners, which may include use of a sensor fusion algorithm (e.g., Kalman filter). Further, when performed as part of the method 1000, various of the operations of the method 1100 may be performed as operations of the method 1000 (e.g., the sensing 1110 may include the measuring of acceleration at 1020 and/or the measuring of angular velocity 1030; the performing 1140 of a further action may include the performing of a further action at 1060 and/or those actions described with respect thereto).

The sensing 1110 of the one or more door conditions is performed with one or more sensors (e.g., the gyroscope 952, the accelerometer 954, the capacitive sensor 956, or the microphone 958) as operated by one or more processors, such as the controller 960. The sensing includes one or more of sensing angular velocity 1112 of the door 10 (e.g., with the gyroscope 952), sensing X-axis acceleration 1114 of the door 10 (e.g., with the accelerometer 954 perpendicular to the plane 11 of the door 10), sensing capacitance 1116 of the building structure 2 (e.g., with the capacitive sensor 956), or sensing sound 1118 (e.g., with the microphone 958).

The sensing of the angular velocity 1112 of the door 10 may be considered to additionally include sensing Y-axis acceleration of the door 10, which indicates movement of the door 10. For example, the gyroscope 952 is not operated to measure angular velocity when the Y-axis acceleration is zero, or the angular velocity measured by the gyroscope 952 thereof are not recorded or processed at times corresponding to when the Y-axis acceleration is zero. As described above, this may reduce inaccuracies in the angular position assessment that might otherwise occur from non-zero measurements of the angular velocity by the gyroscope 952 when the door 10 is not moving.

The sensing 1110 may also include sensing operation of the deadbolt 20, which may, as discussed above, include sensing a position of the deadbolt 20 and/or power draw from the deadbolt operator 210. The sensing 1110 may include an operation of operating the deadbolt operator 210, either as part of an automated operation or in response to a user input.

The individual processing 1120 of the one or more door position conditions to determine the door status is performed with one or more processors, such as the controller 960 (e.g., receiving the sensor data from the various sensors). The individual processing 1120 may include independently processing the angular velocity 1122 of the door 10, processing the X-axis acceleration 1124 of the door 10, processing the capacitance 1126 of the building structure 2, or processing the sound 1128, each of which may include outputting an individual position determination or measure indicating that the door 10 is closed (i.e., based on one of the door position conditions independent of the other door position conditions).

The processing of the angular velocity 1122 includes calculating the angular position assessment of the door 10 from the angular velocity sensed by the gyroscope 952. As referenced above, the angular position assessment is a cumulative calculation of the measurements of the angular velocity 1122 taken over time, such as the sum of each measurement of angular velocity 1122 and the period at which the measurements are taken. To reduce inaccuracies, as described previously above (e.g., at 1040), the angular position assessment may be calculated from measurements of the angular velocity taken when the door 10 is determined to be moving (e.g., the Y-axis acceleration is non-zero). The sensing of angular velocity 1112 and the processing of the angular velocity 1122 may be performed as part of the method 1000 (e.g., the sensing of angular velocity 1030, and the calculating 1040 of the angular position assessment).

The processing of the angular velocity 1122 may also include comparing the angular position assessment to a criterion to one or both of determine (e.g., form a binary determination) or calculate a probability of whether the angular position assessment indicates that that the door 10 is in the closed physical position. This criterion may be referred to as an angular position criterion, which may be a predetermined value. The determination and/or probability calculation may be referred to as an angle- or gyroscope-based position determination. The binary determination and/or probability calculation may be determined in any suitable manner. For example, if the angular position assessment is below 5, 3, 2, 1, or 0.5 degrees (i.e., the angular position criterion), the angular position assessment may be determined to indicate that the door is in the closed physical position (i.e., the angle-based position determination). Alternatively, the closer the angle position assessment to the reference value, the higher the probability calculation.

The processing of the angular velocity 1122 may also include outputting the angular position assessment or the angle-based position determination (e.g., the binary determination and/or probability calculation), for example, to be used in the cooperative processing 1130.

The processing of the X-axis acceleration 1124 of the door 10 includes comparing the measured acceleration to a criterion to one or both of determine (e.g., form a binary determination) or calculate a probability of whether the X-axis acceleration indicates that the door 10 is closed. This criterion may be referred to as an X-axis acceleration criterion, which may be the door closing acceleration profile (as described previously). The determination and probability calculation may each be referred to as the acceleration-based determination.

For example, if the X-axis acceleration favorably compares to the X-axis acceleration, the X-axis acceleration is determined to indicate that the door 10 is in the closed physical position). The measured X-axis acceleration may be compared to the X-axis acceleration criterion in any suitable manner, such as by comparing to the peak accelerations of the acceleration profile (e.g., sequence, direction, and/or ranges of relative magnitude) and/or using a pattern recognition technique (e.g., machine learning).

The X-axis acceleration criterion (e.g., the door closing acceleration profile) may be determined in any suitable manner, for example, being predetermined (e.g., agnostic to the particular physical characteristics of each combination of the door 10 and the building structure 2), determined initially according to a setup process (discussed below), and/or determined over time (e.g., continual or intermittently, such as with machine learning) to account for changes to the physical characteristics of the door 10 and the building structure 2 due to humidity, temperature, and/or wear and otherwise improve accuracy of the determination.

The processing of the X-axis acceleration 1124 may also include outputting the acceleration-based determination (e.g., the binary determination and/or probability calculation) of whether the X-axis acceleration indicates that the door 10 is closed, which may be used in the cooperative processing 1130.

The processing of the capacitance 1126 includes comparing the capacitance to a criterion to one or both of determine (e.g., form a binary determination) or calculate a probability of whether the capacitance indicates that that the door 10 is in the closed physical position. This criterion may be referred to as a building capacitance criterion, while this determination and probability calculation may each be referred to as a capacitance-based position determination. For example, if the capacitance is measured within a range of capacitance values (i.e., the capacitance criterion), the capacitance is determined to indicate that the door 10 is in the closed physical position).

The capacitance criterion may be determined initially according to a setup process (discussed below) and/or determined over time (e.g., continual or intermittently, such as with machine learning) to account for changes to the physical characteristics of the door 10 and the building structure 2 due to humidity, temperature, and/or wear.

The processing of the capacitance 1126 may also include outputting the capacitance-based determination (e.g., the binary determination and/or probability calculation) of whether the capacitance indicates that the door 10 is closed, which may be used in the cooperative processing 1130.

The processing of the sound 1128 includes comparing the sensed sound to a criterion to one or both of determine (e.g., form a binary determination) or calculated a probability of whether the sound indicates that the door 10 is in the closed physical position. This criterion may be referred to as a sound criterion, while this determination and probability calculation may each be referred to as a sound-based position determination.

The sound criterion may be a sound profile that is recorded and/or processed for the particular combination of the door 10 and the building structure 2, which may be processed in any suitable manner (e.g., feature extraction and/or pattern recognition). The sound criterion may be determined initially according to a setup process (discussed below), and/or determined over time (e.g., continual or intermittently, such as with machine learning) to account for changes to the physical characteristics of the door 10 and the building structure 2 due to humidity, temperature, and/or wear.

The sensed sound may be compared to the sound criterion in any suitable manner, for example, by extracting and comparing features to the sound profile and/or using a suitable pattern recognition technique (e.g., machine learning).

The processing of the sound 1128 may also include outputting the sound-based determination (e.g., the binary determination and/or probability calculation) of whether the capacitance indicates that the door 10 is closed, which may be used in the cooperative processing 1130.

The individual processing of the door position conditions 1120 may also include processing operation of the deadbolt 20. For example, determining whether the deadbolt 20 is in the extended or retracted position and/or whether the deadbolt 20 is movable into the extended position.

The cooperative processing 1130 of the door position conditions is performed with a processor, such as the controller 960. The cooperative processing 1130 may be performed in different manners to determine whether the door 10 is closed according to two or more of the door position conditions. The cooperative processing 1130 includes processing the outputs of the individual processing 1120 (e.g., the angular position assessment, binary position determinations, or probability calculations).

The cooperative processing 1130 may be performed according to any suitable methodology, such as requiring one or more of the door position criteria be satisfied, using a weighted sum model (e.g., of the binary and/or probabilistic outputs), and/or using sensor fusion algorithms (e.g., Kalman filter). One or more of the door position criteria may be required to be satisfied, for example, that the angular position is assessment is below an angular threshold (e.g., 10, 5, 3, 2, or 1 degrees) before other conditions are considered (e.g., with a weighted sum model or sensor fusion). In one specific example, if the angular position assessment is below the angular threshold, the physical door position is further assessed according to the accelerometer, the capacitive sensor, and/or the microphone (e.g., to assess whether the door is in the closed physical position).

A weighted sum model may, for example, have a weight associated with each door position condition, multiply the weight by the binary determination (e.g., 0 or 1) or probability calculation, and compare a summation to a threshold to determine whether the door is in the closed position. The weights may be assigned or determined in various manners, for example, the X-axis acceleration may be considered to be a more reliable indicator than the capacitance and, therefore, be assigned a greater weight.

A sensor fusion algorithm, such as a Kalman filter, may be used to assesses two or more of the door position conditions. Inputs to the sensor fusion algorithm may be those outputs of the individual processing 1120 (e.g., the binary determinations and/or probability calculations), or the outputs of one or more of the sensing 1110 operations (e.g., the sensor values, omitting the individual processing operation otherwise associated therewith).

In other examples, one or a combination of the door position conditions may be highly indicative or confirmatory of whether the physical door position (e.g., if closed). For example, if the deadbolt 20 is not movable to the extended position (e.g., based on a high power draw by the deadbolt operator 210), the door 10 may be determined to not be in the closed position (e.g., the deadbolt 20 being not movable indicates the deadbolt 20 is engaging the door jamb). Alternatively, if one or more other door position conditions are indicative of the door 10 being closed, the operation of the deadbolt 20 (e.g., by moving and sensing the deadbolt 20 in the extended position, which may performed or triggered based on one or more of the other door position conditions or based on a user input). Thus, based on operation of the deadbolt 20, the method 1100 and the electronic door system 100 may determine that the door 10 is closed and/or the angular position assessment may be reset to the reference position, such as zero degrees (e.g., in the method 1000 alone or in conjunction with the method 1100).

Referring to FIG. 12, the one or more door position conditions may be assessed by being compared to corresponding door criteria (e.g., the door closing acceleration profile, the building capacitance range, or the sound profile) to determine whether the door 10 is closed. The criteria may be determined according to characteristics that are unique to each different combination of the door 10 and the building structure 2 and may also change over time with varying conditions. For example, different doors 10 may interact with different building structures 2 with different characteristics (e.g., different acceleration profiles, different capacitance levels, and/or different sound profiles). These characteristics may also change over time due to temperature and humidity (e.g., causing expansion and contraction of the door 10 and the building structure 2) and/or as wear occurs.

As shown in FIG. 12, a flow diagram is illustrated for a method 1200 of determining one or more door position criteria by which the door 10 assessed to be closed (e.g., the individual processing 1120 or the cooperative processing 1130 of the method 1100). The method 1200 generally includes instructing 1210 a user to open and close the door 10 with the electronic door system 100 installed thereon, sensing 1220 the door conditions when the door 10 is open and closed according to the instructions, determining 1230 the door position criteria, and repeating 1240 the sensing 1220 and the determining 1230 over time.

The instructing 1210 may be provided by the electronic door system 100, for example, with audible and/or visual instructions or indicators (e.g., with a speaker, light, display, or remote device, such as smartphone). For example, the verbal instructions may be output to the user, or a visual indicator may cue the user to perform the opening and closing according to corresponding written instructions. The instructing 1210 may include instructing the user to open and close the door 10 multiple times and/or with different force.

The sensing 1220 of door conditions is performed with the sensors, as may be operated by a processor, such as the controller 960. The sensing 1220 is performed as the door 10 is being opened and closed. The sensing 1220 includes one or more of sensing angular velocity 1222 (e.g., with the gyroscope 952), sensing acceleration 1224 (e.g., with the accelerometer 954), sensing capacitance 1226 (e.g., with the capacitive sensor 956), or sensing sound 1228 as the door is closed and/or opened (e.g., with the microphone 958). The sensing of acceleration 1224 and the sensing of sound 1228 are performed at least while the door is being closed (e.g., the angular position assessment is under 10 degrees, 5 degrees, or less), because the acceleration and sound criteria may be associated with the action of the door being closed. The sensing of capacitance 1226 is performed while the door 10 is in the closed position and may also be performed while the door 10 is in an open position (e.g., since the capacitance criterion may, in some embodiments, be based on a difference in the capacitance sensed in the open and closed positions).

The determining 1230 of the door position criteria is performed with a processor, such as the controller 960 or the processor of another computing device to which the sensor data is sent (e.g., a cloud computer or remote device, such as a smartphone). The determining 1230 includes one or more of determining an angular position criterion 1232, determining an acceleration criterion 1234, determining a capacitive criterion 1236, or determining a sound criterion 1238.

The determining of the acceleration criterion 1234 includes processing the X-axis acceleration measurements obtained from the sensing of the X-axis acceleration 1224 as the door 10 is closed one or more times (e.g., with the angular position assessment being within 10, 5, or fewer degrees from closed). The door closing acceleration profile may be determined from the X-axis acceleration measurements in any suitable manner, such as by identifying characteristic features (e.g., peak acceleration), a curve-fitting algorithm, and/or machine learning.

The determining of the capacitance criterion 1236 includes processing the capacitance measurements obtained from the sensing of capacitance 1226. The capacitance criterion is determined according to the capacitance measured while the door 10 is in the closed position. For example, the capacitance criterion may be a range of capacitance values that surround the capacitance value measured while the door 10 is in the closed position (e.g., an average capacitance plus and minus one or two standard deviations or other suitable range therearound).

As referenced above, the capacitance criterion may be based on a difference between capacitance sensed when in an open position and the closed position, which represents the contribution of the building structure 2 to the sensed capacitance (e.g., the building-only capacitance). Capacitance sensed by the capacitive sensor 956 may include other sources of capacitance, which may include generally constant sources of capacitance (e.g., the door 10 itself) and may also include variable sources of capacitance (e.g., precipitation and/or objects contacting the electrode 956*a* of the capacitive sensor 956). Accordingly, the capacitance criterion may include a component that is attributable to the building structure 2 (i.e., building-only capacitance), such as the average building-only capacitance (i.e., difference in capacitance between the open and closed positions) and surrounding range (e.g., plus/minus one or two standard deviations). When later assessing the building capacitance condition to determine whether the door 10 is closed, the capacitance is re-measured when the door is open (i.e., the open-door capacitance) and the building-only capacitance (value or range) is added thereto to determine form the capacitance criterion.

In some combinations of different doors 10 and building structures 2, the difference between the capacitance measured while the door 10 is open and closed (i.e., the building-only capacitance) is too small to reliably be used to determine whether the door 10 is closed. For example, there may be no difference in capacitance between the open and closed positions, or the capacitance in the open position might be contained within the range that would otherwise be established for the capacitance criterion. In such instances, the capacitance criterion may not be utilized when determining whether the door 10 is closed (e.g., the sensing of capacitance 1116, and the processing of the capacitance 1126 may not be performed), or the building capacitance position condition may be given less weight when determining whether the door 10 is closed.

The determining of the sound criterion 1238 includes processing the sound sensed from the sensing of the sound 1228 as the door 10 is closed one or more times (e.g., with the angular position assessment being within 10, 5, or fewer degrees from closed). The sound profile may be determined from the captured sound in any suitable manner, such as such as by identifying characteristic features, a curve-fitting algorithm, or machine learning.

The repeating 1240 of the sensing 1220 and the determining 1230 is performed over time, for example, over days, months, and/or years with each instance or a subset of instances (e.g., periodic) that the door 10 is opened and closed. As referenced above, the repeating 1240 may allow for the different door position criteria to be updated according to changing characteristics of the door 10 and the building structure 2 and may otherwise provide for a more robust data set from which the door position criteria may be determined to more accurately determine whether the door 10 is closed.

The initial and updated door position criterion may be used to assess whether the door 10 is in the closed physical position, for example, as part of the method 1100. As a result, the door position condition may be: sensed at a first time to establish the initial door position criterion; sensed at a second time and compared to the initial door position criterion to assess the physical position of the door (e.g., assess whether the door is closed); assessed at a third time to establish an updated door position criterion that is different from the first door position criterion; and assessed at a fourth time and compared to the updated door position criterion to assess the physical position of the door (e.g., assess whether the door is closed). The third time may, for example, be one week, one month, or one year or more after the first time.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by software programs executable by a computer system. Further, in an exemplary, non-limited embodiment, implementations can include distributed processing, component/object distributed processing, and parallel processing. Alternatively, virtual computer system processing can be constructed to implement one or more of the methods or functionality as described herein.

Further the methods described herein may be embodied in a computer-readable medium. The term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

As a person skilled in the art will readily appreciate, the above description is meant as an illustration of the principles of this invention. This description is not intended to limit the scope or application of this invention in that the invention is susceptible to modification, variation and change, without departing from spirit of this invention, as defined in the following claims.

While the disclosure has been described in connection with certain embodiments, it is to be understood that the disclosure is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

Various embodiment described above and disclosed below are contemplated by the present disclosure:

Embodiment 1. An electronic door system for a door that selectively closes a door opening of a building structure, the system comprising:

two or more of a gyroscope that senses angular velocity of the door, an accelerometer that senses acceleration of the door, a capacitive sensor that capacitively senses the building structure, or a microphone that senses sound of the door; and a controller that assesses a physical position of the door according to the two or more of the gyroscope, the accelerometer, the capacitive sensor, or the microphone.

Embodiment 2. The electronic door system according to Embodiment 1, comprising the gyroscope, the accelerometer, the capacitive sensor, and the microphone, and further comprising a wireless communications device;

wherein the controller assesses the physical position of the door by determining an angular position assessment of the door according to the gyroscope;

wherein if the angular position assessment is below an angular threshold of 10 degrees or less from a closed physical position, the controller assesses the physical position according to the accelerometer, the capacitive sensor, and the microphone;

wherein the controller compares the acceleration of the door sensed by the accelerometer to an acceleration profile of the door indicative of the door being closed to assess the physical position of the door;

wherein the controller compares the capacitance sensed by the capacitive sensor to a capacitance criterion indicative of the door being closed to assess the physical position of the door, the capacitance criterion having been determined according to a previous occurrence of capacitively sensing the building structure with the capacitive sensor with the door in a closed physical position;

wherein the controller compares the sound sensed by the microphone to a sound criterion to assess the physical position of the door, the sound criterion having been determined according to a previous occurrence of sensing the sound with the microphone while the door was moved into the closed physical position;

wherein the electronic door system is coupleable to the door such that the gyroscope, the accelerometer, the capacitive sensor, and the microphone move with the door as the door is moved to selectively close the door opening of the building structure; and wherein the controller assesses the physical position of the door to determine a door status, and the wireless communications device communicates the door status to another device.

Embodiment 3. The electronic door system according to Embodiment 1, wherein the controller assesses the physical position of the door by assessing whether the door is closed according to the two or more of the gyroscope, the accelerometer, the capacitive sensor, or the microphone.

Embodiment 4. The electronic door system according to any of Embodiments 1 or 3, comprising three or more of the gyroscope, the accelerometer, the capacitive sensor, or the microphone, wherein the controller assesses the physical position of the door according to the three or more of the gyroscope, the accelerometer, the capacitive sensor, or the microphone.

Embodiment 5. The electronic door system according to Embodiment 4, comprising the gyroscope, the accelerometer, the capacitive sensor, and the microphone, wherein the controller assesses the physical position of the door according to the gyroscope, the accelerometer, the capacitive sensor, and the microphone.

Embodiment 6. The electronic door system according to any of Embodiment 1 or 3-5, comprising the gyroscope, wherein the controller assesses the physical position of the door by determining an angular position assessment of the door according to the gyroscope.

Embodiment 7. The electronic door system according to Embodiment 6, comprising the accelerometer, if the angular position assessment is below an angular threshold of 10 degrees or less from a closed physical position, the controller assesses whether the door is in the closed physical position according to the accelerometer.

Embodiment 8. The electronic door system according to any of Embodiments 1 or 3-7, comprising the accelerometer, wherein the controller compares the acceleration of the door sensed by the accelerometer to an acceleration profile of the door indicative of the door being closed to assess the physical position of the door.

Embodiment 9. The electronic door system according to Embodiment 8, wherein the acceleration profile includes a first peak acceleration that represents the door engaging a door stop of the building structure and a second peak acceleration that represents a spring latch of the door engaging a corresponding latch receptacle of the building structure.

Embodiment 10. The electronic door system according to any of Embodiments 1 or 3-9, comprising the capacitive sensor, wherein the controller compares the capacitance sensed by the capacitive sensor to a capacitance criterion indicative of the door being closed to assess the physical position of the door.

Embodiment 11. The electronic door system according to Embodiment 10, wherein the capacitance criterion is determined according to a previous occurrence of capacitively sensing the building structure with the capacitive sensor with the door in a closed physical position.

Embodiment 12. The electronic door system according to any of Embodiments 1 or 3-11, comprising the microphone, wherein the controller compares the sound sensed by the microphone to a sound criterion to assess the physical position of the door, the sound criterion having been determined according to a previous occurrence of sensing the sound with the microphone while the door was being closed.

Embodiment 13. The electronic door system according to any of Embodiments 1 or 3-12, wherein the electronic door system is coupleable to the door such that the two or more of the gyroscope, the accelerometer, the capacitive sensor, or the microphone move with the door as the door is moved to selectively close the door opening of the building structure.

Embodiment 14. The electronic door system according to any of Embodiments 1 or 3-13, further comprising a wireless communications device, wherein the controller assesses the physical position of the door to determine a door status, and the wireless communications device communicates the door status to another device.

Embodiment 15. The electronic door system according to any of Embodiments 1 or 3-14, further comprising a deadbolt operator that operates a deadbolt to lock the door to the building structure, wherein the controller assesses the physical position of the door to determine a door status, and the controller operates the deadbolt according to the door status.

Embodiment 16. An electronic door system for a door that selectively closes a door opening of a building structure, the system comprising:

a capacitive sensor that capacitively senses the building structure; and a controller that assesses whether the door is closed according to the capacitive sensor.

Embodiment 17. The electronic door system according to Embodiment 16, further comprising a gyroscope that senses angular velocity of the door, wherein the controller assesses whether the door is closed according to the gyroscope.

Embodiment 18. The electronic door system according to any of Embodiments 16 or 17, further comprising an accelerometer that senses acceleration of the door in a direction perpendicular to a plane of the door, wherein the controller assesses whether the door is closed according to the accelerometer.

Embodiment 19. A method for assessing a physical position of a door that selectively closes a door opening of a building structure, the method comprising:

sensing at a first time, with a sensor, a door position condition that is indicative of the physical position of the door;

determining, with a controller, a door position criterion according to the door position condition from the first time;

sensing at a second time, with the sensor, the door position condition, the second time being after the first time; and comparing, with the controller, the door position condition from the second time to the door position criterion to assess the physical position of the door;

wherein the sensor is one of an accelerometer, a capacitive sensor, or a microphone, and the door position condition is one of acceleration of the door in a direction perpendicular to a plane of a door, capacitance of the building structure, or a sound of the door closing.

Embodiment 20. The method according to Embodiment 19, further comprising:

sensing at a third time, with the sensor, the door position condition, the third time being after the second time;

determining, with the controller, an updated door position criterion according to the door position condition from the third time;

sensing at a fourth time, with the sensor, the door position condition, the fourth time being after the third time; and comparing, with the controller, the door position condition from the fourth time to the updated door position criterion to assess the physical position of the door.

Embodiment 21, the methods of any of Embodiments 19-20 as used with the electronic door system of any of Embodiments 1-18.

What is claimed is:

1. An electronic door system for a door that selectively closes a door opening of a building structure, the system comprising:

a gyroscope that senses angular velocity of the door;

an accelerometer that senses acceleration of the door; and a controller that assesses a physical position of the door according to the gyroscope and the accelerometer;

wherein the controller assesses the physical position of the door by determining an angular position assessment of the door according to the gyroscope, and if the angular position assessment is below an angular threshold of 10 degrees or less from a closed physical position, the controller assesses whether the door is in the closed physical position according to the accelerometer.

2. The electronic door system according to claim 1, further comprising a capacitive sensor, a microphone, and a wireless communications device;

wherein if the angular position assessment is below an angular threshold of 10 degrees or less from a closed physical position, the controller assesses the physical position according to the accelerometer, the capacitive sensor, and the microphone;

wherein the controller compares the acceleration of the door sensed by the accelerometer to an acceleration profile of the door indicative of the door being closed to assess the physical position of the door;

wherein the controller compares the capacitance sensed by the capacitive sensor to a capacitance criterion indicative of the door being closed to assess the physical position of the door, the capacitance criterion having been determined according to a previous occurrence of capacitively sensing the building structure with the capacitive sensor with the door in a closed physical position;

wherein the controller compares the sound sensed by the microphone to a sound criterion to assess the physical position of the door, the sound criterion having been determined according to a previous occurrence of sensing the sound with the microphone while the door was moved into the closed physical position;

wherein the electronic door system is coupleable to the door such that the gyroscope, the accelerometer, the capacitive sensor, and the microphone move with the door as the door is moved to selectively close the door opening of the building structure; and wherein the controller assesses the physical position of the door to determine a door status, and the wireless communications device communicates the door status to another device.

3. The electronic door system according to claim 1, wherein the controller assesses the physical position of the door by assessing whether the door is closed according to the gyroscope and the accelerometer.

4. The electronic door system according to claim 1, further comprising a capacitive sensor, wherein the controller assesses the physical position of the door according to the gyroscope, the accelerometer, and the capacitive sensor.

5. The electronic door system according to claim 4, further comprising a microphone, wherein the controller assesses the physical position of the door according to the gyroscope, the accelerometer, the capacitive sensor, and the microphone.

6. The electronic door system according to claim 1, wherein the controller compares the acceleration of the door sensed by the accelerometer to an acceleration profile of the door indicative of the door being closed to assess the physical position of the door.

7. The electronic door system according to claim 6, wherein controller assesses whether the door is in the closed physical position according to the accelerometer by comparing the acceleration of the door sensed by the accelerometer to a first peak acceleration of the acceleration profile and a second peak acceleration of the acceleration profile, the first peak acceleration representing the door engaging a door stop of the building structure and the second peak acceleration representing a spring latch of the door engaging a corresponding latch receptacle of the building structure.

8. The electronic door system according to claim 1, further comprising a capacitive sensor, wherein the controller compares the capacitance sensed by the capacitive sensor to a capacitance criterion indicative of the door being closed to assess the physical position of the door.

9. The electronic door system according to claim 8, wherein the capacitance criterion is determined according to a previous occurrence of capacitively sensing the building structure with the capacitive sensor with the door in a closed physical position.

10. The electronic door system according to claim 1, further comprising a microphone, wherein the controller compares the sound sensed by the microphone to a sound criterion to assess the physical position of the door, the sound criterion having been determined according to a previous occurrence of sensing the sound with the microphone while the door was being closed.

11. The electronic door system according to claim 1, wherein the electronic door system is coupleable to the door such that the gyroscope and the accelerometer move with the door as the door is moved to selectively close the door opening of the building structure.

12. The electronic door system according to claim 1, further comprising a wireless communications device, wherein the controller assesses the physical position of the door to determine a door status, and the wireless communications device communicates the door status to another device.

13. The electronic door system according to claim 1, further comprising a deadbolt operator that operates a deadbolt to lock the door to the building structure, wherein the controller assesses the physical position of the door to determine a door status, and the controller operates the deadbolt according to the door status.

14. An electronic door system for a door that selectively closes a door opening of a building structure, the system comprising:

a capacitive sensor that capacitively senses the building structure, the capacitive sensor being configured to electrically couple to a deadbolt of the door for the deadbolt to function as an electrode of the capacitive sensor for capacitively sensing the building structure; and a controller that assesses whether the door is closed according to the capacitive sensor.

15. The electronic door system according to claim 14, further comprising a gyroscope that senses angular velocity of the door, wherein the controller assesses whether the door is closed according to the gyroscope.

16. The electronic door system according to claim 15, further comprising an accelerometer that senses acceleration of the door in a direction perpendicular to a plane of the door, wherein the controller assesses whether the door is closed according to the accelerometer.

17. The electronic door system according to claim 7, further comprising a capacitive sensor for capacitively sensing the building structure, wherein the controller compares the capacitance sensed by the capacitive sensor to a capacitance criterion indicative of the door being closed to assess the physical position of the door.

18. The electronic door system according to claim 7, further comprising a capacitive sensor for capacitively sensing the building structure, wherein the controller assesses the physical position of the door according to the gyroscope, the accelerometer, and the capacitive sensor according to one or more of a weighted sum model thereof or a sensor fusion algorithm thereof.

19. The electronic door system according to claim 14, further comprising a deadbolt operator having a motor that is controlled by the controller to operate the deadbolt.

20. An electronic door system for a door of a building structure, the system comprising:

an accelerometer that senses acceleration of a door; and a controller that assesses whether the door is closed by comparing the acceleration of the door sensed by the accelerometer to a first peak acceleration of an acceleration profile of the door and a second peak acceleration of the acceleration profile of the door, the first peak acceleration representing the door engaging a door stop of the building structure and the second peak acceleration representing a spring latch of the door engaging a corresponding latch receptacle of the building structure.

* * * * *